US011167331B2

(12) United States Patent
Kitagoh

(10) Patent No.: US 11,167,331 B2
(45) Date of Patent: Nov. 9, 2021

(54) TEMPERATURE CONTROL DEVICE FOR ENDLESS ROLLING LINE

(71) Applicant: TOSHIBA MITSUBISHI-ELECTRIC INDUSTRIAL SYSTEMS CORPORATION, Chuo-ku (JP)

(72) Inventor: Kazutoshi Kitagoh, Tokyo (JP)

(73) Assignee: TOSHIBA MITSUBISHI-ELECTRIC INDUSTRIAL SYSTEMS CORPORATION, Chuo-ku (JP)

( * ) Notice: Subject to any disclaimer, the term of this patent is extended or adjusted under 35 U.S.C. 154(b) by 83 days.

(21) Appl. No.: 16/628,503

(22) PCT Filed: Aug. 4, 2017

(86) PCT No.: PCT/JP2017/028474

§ 371 (c)(1),
(2) Date: Jan. 3, 2020

(87) PCT Pub. No.: WO2019/026292

PCT Pub. Date: Feb. 7, 2019

(65) Prior Publication Data

US 2020/0222958 A1 Jul. 16, 2020

(51) Int. Cl.
*B21B 37/74* (2006.01)
*B21B 1/22* (2006.01)

(52) U.S. Cl.
CPC ..... *B21B 37/74* (2013.01); *B21B 1/22* (2013.01); *B21B 2001/225* (2013.01)

(58) Field of Classification Search
CPC ..... B21B 37/74; B21B 1/22; B21B 2001/225; B21B 38/006; B21B 1/463; B22D 11/12
See application file for complete search history.

(56) References Cited

FOREIGN PATENT DOCUMENTS

| | | | | |
|---|---|---|---|---|
| EP | 0730916 A1 * | 9/1996 | ..... | B21B 37/26 |
| JP | S56114521 A * | 2/1980 | ..... | B21B 37/00 |
| JP | 56-114521 A | 9/1981 | | |
| JP | 6-142733 A | 5/1994 | | |

(Continued)

OTHER PUBLICATIONS

International Search Report dated Sep. 26, 2017 in PCT/JP2017/028474 filed Aug. 4, 2017.

(Continued)

*Primary Examiner* — Adam J Eiseman
*Assistant Examiner* — P Derek Pressley
(74) *Attorney, Agent, or Firm* — Oblon, McClelland, Maier & Neustadt, L.L.P.

(57) ABSTRACT

In an endless rolling line, a speed of a material to be rolled changes with a flying thickness change. A temperature control device executes predictive calculation of a speed change amount of the material to be rolled associated with the flying thickness change and updates a speed pattern. The temperature control device executes feedforward control of an amount of a coolant to cool the material to be rolled based on a latest speed pattern and a measured temperature value of the material to be rolled in an entry side of the heat exchanger. In parallel with the feedforward control, the temperature control device executes feedback control of coolant volume based on an error between the measured temperature value of the material to be rolled in the delivery side of the heat exchanger and a target value.

4 Claims, 15 Drawing Sheets

(56) References Cited

FOREIGN PATENT DOCUMENTS

| | | | | | |
|---|---|---|---|---|---|
| JP | 8-300010 | A | | 11/1996 | |
| JP | 2010-529907 | A | | 9/2010 | |
| JP | 2013-163189 | A | | 8/2013 | |
| JP | 2013163189 | A | * | 8/2013 | ..... B21B 37/00 |
| JP | 5733230 | B2 | | 6/2015 | |

OTHER PUBLICATIONS

Indian Office Action dated Sep. 18, 2020 in Patent Application No. 201917053811, 6 pages.

* cited by examiner

Timing 1

Timing 2

Timing 3

Timing 6.1

Timing 6.2

Timing 6.3

Timing 6.4

Timing 6.5

Timing 6.6

Timing 6.7

Timing 1

Timing 2

Timing 3

Timing 1

Timing 2

Timing 3

TEMPERATURE CONTROL DEVICE FOR ENDLESS ROLLING LINE

FIELD

The present invention relates to a temperature control device for endless rolling line. More particularly, the present invention relates to the temperature control device which is configured to control temperature of a material to be rolled in an endless rolling line.

BACKGROUND

JPH8-300010A discloses a hot rolling device which performs a flying thickness change in which a target plate thickness of a material to be rolled in a delivery side of a mill is changed during rolling, i.e. during flying. The hot rolling device comprises a roughing mill and a finishing mill. A slab rolled by the roughing mill is called as a rough bar and it is rolled in the roughing mill down to a target thickness of the rough bar as an intermediate. The finishing mill continuously rolls the rough bar from the roughing mill and downs plate thickness of the rough bar to a target product thickness. The rough bar rolled by the finishing mill is called as a strip. Since name varies depending on its site, the material to be rolled that spans two or more of the roughing mill, the finishing mill and the delivery side of the finishing mill will be also referred to simply as a "rolling material" in this specification. The flying thickness change is performed by changing the target bar thickness in the roughing mill and/or changing the target (product) thickness in the delivery side of the finishing mill. According to the flying thickness change, a plurality of coils differing in thickness can be manufactured from a single slab.

In recent years, the endless rolling line for manufacturing coils by directly connecting a continuous caster with a hot rolling line has been constructed. In the endless rolling line, it is unnecessary to reheat the slab for rolling in the hot rolling line after the slab cast in the continuous caster is once cooled. Therefore, according to the endless rolling line, it is possible to reduce energy consumption amount involved in manufacturing the coils.

As a technique related to the flying thickness change in the endless rolling line, there is a temperature control device disclosed in JP5733230B. When the plate thicknesses of a preceding material and a succeeding material differ due to the flying thickness change, this temperature control device calculates speed change amount of the rolling material so that an end portion of the succeeding material is kept within a desired temperature range when a head end of the succeeding material is located in the delivery side of the finishing mill. The temperature control device also changes and makes constant speed of the rolling material, based on calculated speed change amount of the rolling material, before a tail end portion of the preceding material passes through the finishing mill. This temperature control device also changes roll gaps of stands of the finishing mill and tension between these stands so that the plate thickness of the rolling material (i.e., succeeding material) after the flying thickness change is of the desired thickness. According to such the temperature control, it become possible to control the temperature of the succeeding material within a permissible range.

However, in the temperature control, the roll gaps of the stands of the finishing mill and the tension between these stands are changed based on predictions executed before the flying thickness change. According to the temperature control, it become possible to keep the speed of the rolling material in the delivery side of the finishing mill constant when the tail end portion of the preceding material passes through the finishing mill. However, in the endless rolling line, casting speed of the continuous caster is dominant and it is difficult to change the speed of the rolling material to a desired rate. Therefore, when considering even such the constraint on speed change, the temperature control is insufficient and there is room for improvement.

Another technique related to the flying thickness change in the endless rolling line is the temperature control device disclosed in JP2010-529907A. The temperature control device detects or presets the casting speed or mass flow (multiplication of plate thickness and casting speed) of the slab and controls strip temperature in the delivery side of the finishing mill in view of change in the casting speed or the mass flow. However, this temperature control is not a control that incorporates speed change of the roughing mill and/or that of the delivery side of the finishing mill associated with the flying thickness change into speed pattern. For this reason, countermeasures against the speed change of the rolling material changes associated with the flying thickness change are inadequate and there is room for improvement.

CITATION LIST

Patent Literature

[PTL 1] JPH8-300010A
[PTL 2] JP5733230B
[PTL 3] JP2010-529907A

SUMMARY

Technical Problem

The present invention has been made to solve the problems mentioned above, and an object of the present invention is to provide the temperature control device in which controllability of temperature of the rolling material is enhanced when the flying thickness change of the rolling material is performed in the endless rolling line.

Solution to Problem

In order to achieve the object mentioned above, the present invention is a temperature control device for endless rolling line which is configured to control temperature of a material to be rolled to in an endless rolling line in which a continuous caster is directly connected with a hot rolling line.

The endless rolling line comprising:

a heating furnace which is configured to heat the material to be rolled extracted from the continuous caster;

a mill which is configured to roll the material to be rolled extracted from the heating furnace with a plurality of stands;

a heat exchanger which is disposed downstream of the mill and/or between the stands of the mill, and is configured to exchange heat with at least one of the material to be rolled after rolling by the mill and the material to be rolled during rolling by the mill;

a delivery-side thermometer which is disposed downstream of the heat exchanger; and an entry-side thermometer which is disposed upstream of the heat exchanger.

The temperature control device is further configured to:

calculate a plate thickness schedule which defines stand delivery-side target plate thicknesses which are target values of the material to be rolled in each delivery side of the stands based on an operation instruction including a target plate length which is a target value of plate length of the material to be rolled, a mill delivery-side target plate thickness which is the target value of plate thickness of the material to be rolled in the delivery side of the mill, and a target temperature which is a target value of temperature of the material to be rolled when it passes through a position where the delivery-side thermometer is disposed;

execute predictive calculation of speed change amount of the material to be rolled in each delivery side of the stands that changes when the mill delivery-side target plate thickness is changed based on the plate thickness schedule and the speed of material to be rolled in each delivery side of the stands;

create a speed patter on the material to be rolled based on the speed change amount;

execute feedforward control of heat exchanging amount based on the latest speed pattern of the material to be rolled and a measured temperature value from the entry-side thermometer; and execute feedback control of the heat exchanging amount based on an error between the measured temperature value from the delivery-side thermometer and the target temperature.

The temperature control device is further configured to:

create the speed pattern of a preceding material at which a head end portion of the preceding material is extracted from the heating furnace;

execute first update of the speed pattern of the preceding material at which the head end portion of the preceding material reaches the mill;

execute second update of the speed pattern of the preceding material and create the speed pattern of a succeeding material at which the head end portion of the succeeding material is extracted from the heating furnace; and execute third update of the speed pattern of the preceding material and update of the speed pattern of the succeeding material at which the head end portion of the succeeding material reaches the mill.

The temperature control device may be further configured to:

calculate, based on the operation instruction, a plate thickness changing time as time required to change the plate thickness of the material to be rolled in the delivery side of the mill when the mill delivery-side target plate thickness is changed;

calculate speed change rate of the material to be rolled in each delivery side of the stands in case of changing the mill delivery-side target plate thickness by dividing the speed change amount by the plate thickness changing time; and if the speed change rate of the stand is outside a permissible range, change the stand delivery-side target plate thickness of the same stand.

The temperature control device may be further configured to:

calculate rolling reduction rate of each stand in case of changing the mill delivery-side target plate thickness; and if the rolling reduction rate of the stand is outside the permissible range, change the stand delivery-side target plate thickness of the same stand.

Advantageous Effects of Invention

According to the present invention, it is possible to execute predictive calculation of the speed change amount of the material to be rolled accompanied by the flying thickness change, to create or update the speed pattern based on this speed change amount, and to execute feedforward control and feedback control of the heat exchanging amount in the heat exchanger. Therefore, it is possible to control with a high degree of accuracy the temperatures of the preceding material and the succeeding material in the delivery side of the mill within the permissible range.

DESCRIPTION OF EMBODIMENTS

Hereinafter, embodiments of the present invention will be described in detail with reference to the drawings. Note that, even when the embodiments below mention about a value such as number, quantity, amount and range, the present invention is not limited by the referred values unless the value is explicitly referred in the present invention or clearly specified to the value in principle. In addition, the configuration and the steps of the embodiments below are not essential to the present invention unless explicitly referred in the embodiments or clearly specified to the configuration in principle.

First Embodiment

First, a first embodiment of the present invention will be described with reference to FIGS. 1 to 11.

<Endless Rolling Line>

Figure 1:
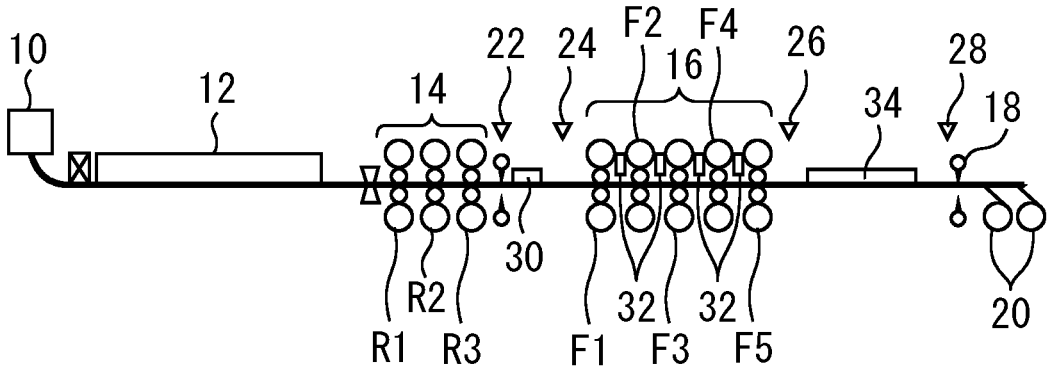
FIG. 1 is a diagram for illustrating an exemplary configuration of an endless rolling line to which a temperature control device according to an embodiment of a first embodiment of the present invention is applied.

FIG. 1 is a diagram for illustrating an exemplary configuration of an endless rolling line to which a temperature control device according to an embodiment of a first embodiment of the present invention is applied.

The endless rolling line shown in FIG. 1 comprises a continuous caster 10, a heating furnace 12, a roughing mill 14, a finishing mill 16, a coiler entry-side shear 18 and a coiler 20 as main facilities.

The continuous caster 10 continuously casts slabs. The heating furnace 12 heats the slab extracted from the continuous caster 10 and sends it to the roughing mill 14. The roughing mill 14 usually includes two to four stands (a first stand R1 to a third stand R3 in FIG. 1). The roughing mill 14 rolls the slab from the heating furnace 12 by its stands. In a delivery side of the roughing mill 14, the rolled slab is referred to as a rough bar and is rolled down with the roughing mill until a rough bar thickness to a target.

The rough bar rolled by the roughing mill 14 is sent to the finishing mill 16. The finishing mill 16 usually includes five to seven stands (a first stand F1 to fifth stand F5 in FIG. 1). The finishing mill 16 further rolls the rough bar from the roughing mill 14 by its stands. In the delivery side of the finishing mill 16, the rolled rough bar is called a strip and is reduced by the finishing mill to a target plate thickness (a product thickness) of the strip.

The strip rolled by the finishing mill 16 is sent to the coiler 20. The coiler 20 winds the strip from the finishing mill 16 into a coil. In the endless rolling, the coiler entry-side shear 18 cuts the strip around a plate thickness change to produce a plurality of coils from a successively cast slab. As shown in FIG. 1, the coiler 20 includes at least two. For example, when the strip located downstream of a cut point (coiler side) (hereinafter also referred to as a "preceding material") is wound by the coiler 20 on a frontward-side (i.e., a side remote from the finishing mill 16), the strip located upstream of the cut point (mill side) (hereinafter also referred to as a "succeeding material") will be wound by the coiler 20 on a rearward-side (i.e., a side close to the finishing mill 16). During the strip is wound by the coiler 20 on the rearward-side, the coil wound by the coiler 20 on the frontward-side is dispensed and the coiler 20 on the frontward-side prepares for winding after a subsequent cut.

The endless rolling line shown in FIG. 1 measures temperature of the rolling material at various points for stable rolling and material management of products. A roughing mill delivery-side thermometer 22 measures temperature of the rough bar in the delivery side of the roughing mill 14. A finishing mill entry-side thermometer 24 measures the temperature of the rough bar in the entry side of the finishing mill 16. A finishing mill delivery-side thermometer 26 measures the temperature of the strip in the delivery side of the finishing mill 16. A coiler entry-side thermometer 28 measures the temperature of the strip upstream of the coiler 20. The temperatures of the rolling material measured at various points are used as inputs of temperature control executed by a temperature control device.

The endless rolling line comprises a heat exchanger 30 and coolers 32 and 34 as actuators operated in accordance with the temperature control. The heat exchanger 30 heats or cools the rough bar. The heat exchanger 30 heats the rough bar, for example by induction heating, but may also heat the rough bar by combustion heat of fuels. The heat exchanger 30 cools the rolling material, for example, with coolant from spray nozzles. Upon cooling, a heat insulating cover for controlling falling amount of the temperature of the rough bar may be used as appropriate. The cooler 32 is provided between two adjacent stands in the finishing mill 16. The cooler 32 cools the strip, for example, with the coolant from the spray nozzles. The cooler 34 cools the strip, for example, with the coolant from laminar nozzles.

<Explanation of Operation in Endless Rolling Line>

A basic operation in the endless rolling line will be explained. In a successive rolling, a plurality of coils which differ in plate thickness are produced from a single slab. Specifically, roll gaps of the stands of the roughing mill 14 and the finishing mill 16 are changed during the rolling of the rolling material. At the same time, tensions between these stands are changed. In this way, the bar thickness in the delivery side of the roughing mill 14 and the plate thickness in the delivery side of the finishing mill 16 are changed. A cutting position is determined in advance from a target plate length or the like prior to the rolling, and when the cutting position arrives at the coiler entry-side shear 18, the strip is cut. The cutting of the strip is performed around a plate thickness change part in order to reduce a yield as much as possible. In this way, the coil from the preceding material and the coil from the succeeding material that differs from the preceding material in the plate thickness are manufactured.

In the endless rolling line, the single slab extracted from the continuous caster 10 is sent to the rolling line. Therefore, speed of the slab in the entry side of the roughing mill 14 is governed by manufacturing speed (i.e., casting speed) of the slab in the continuous caster 10. If the casting speed is constant, the speed of the rolling material in the stand delivery side changes in accompany with the flying thickness change. This change in speed of the rolling material results in temperature control disturbances.

<Configuration Temperature Control Device>

Figure 2:
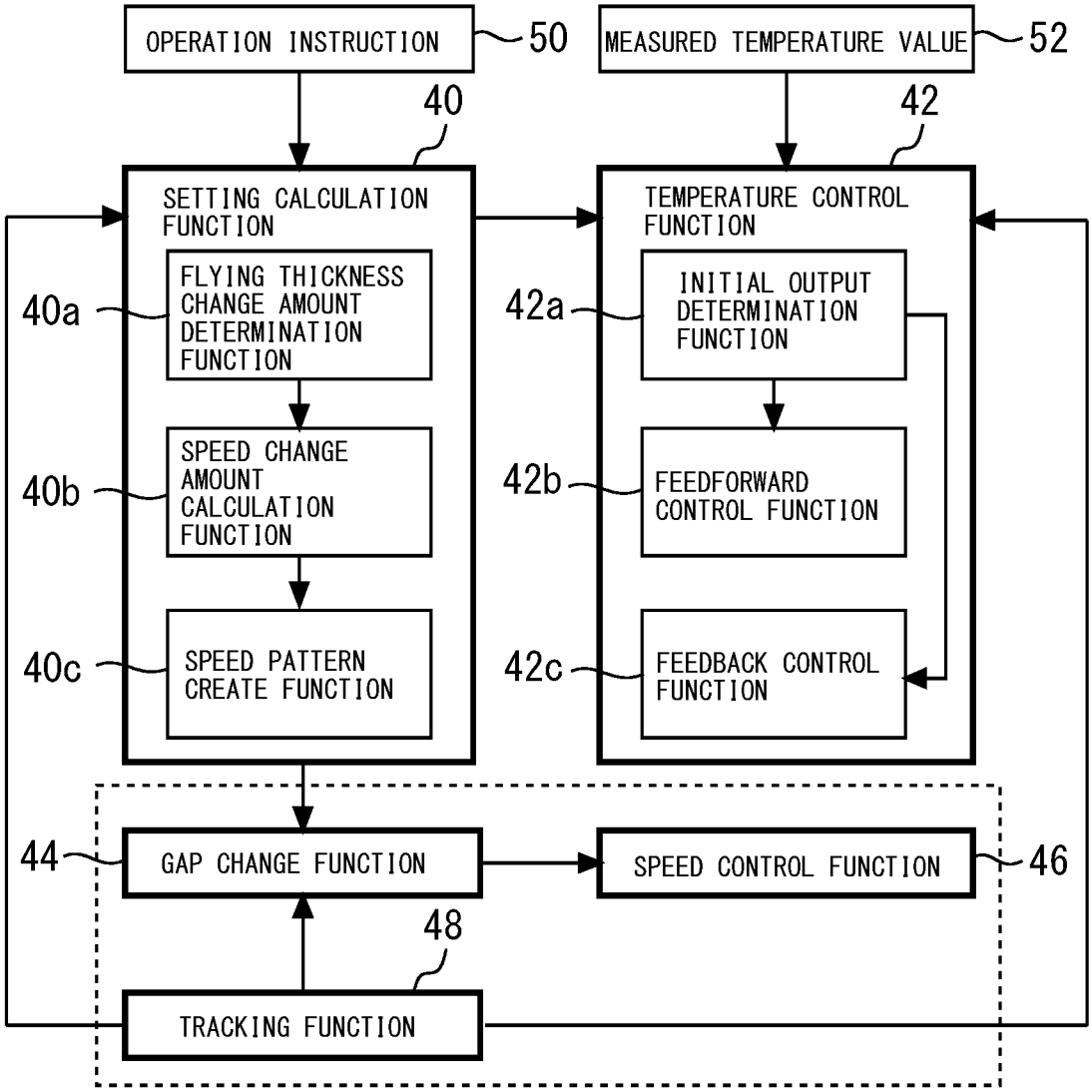
FIG. 2 is a block diagram for illustrating the exemplary configuration of the temperature control device according to the first embodiment of the present invention.

FIG. 2 is a block diagram for illustrating the exemplary configuration of the temperature control device according to the first embodiment of the present invention. The temperature control device shown in FIG. 2 includes a setting calculation function 40, a temperature control function 42, a gap change function 44, a speed control function 46 and a tracking function 48 as main functions.

The setting calculation function 40 is a function to determine a plate thickness changing point based on a plate thickness of the preceding material and a target plate length of the preceding material. The setting calculation function 40 includes as low-order functions a flying thickness change amount determination function 40*a*, a speed change amount calculation function 40*b* and a speed pattern create function 40*c*.

The flying thickness change amount determination function 40*a* is a function to calculate the plate thickness schedule and plate thickness changing time based on an operation instruction 50. In the plate thickness schedule, target values of the plate thickness of the rolling material in the delivery side of the stands are set per stand. The plate thickness changing time is a period in which the plate thickness corresponding to the target plate thickness of the preceding material is changed to the plate thickness corresponding to the target plate thickness of the succeeding material. The plate thickness changing time is calculated based on at least one of the plate thickness target value of the succeeding material in the delivery side of the finishing mill and the plate thickness change amount of the strip in the finishing delivery side of the mill (i.e., a difference between the product plate thicknesses of the preceding material and the succeeding material). That is, the plate thickness changing time is calculated based on the plate thickness schedule.

The speed change amount calculation function 40*b* is a function to execute predictive calculation of the speed change amount of the rolling material associated with the flying thickness change. The speed change amount is calculated based on the plate thickness schedule of the succeeding material, the plate thickness schedule of the preceding material, and the speed of the rolling material in each delivery side of the stands. The detail of the speed change amount calculation function 40*b* will be described later.

The speed pattern create function 40*c* is a function to create or update the speed pattern of the rolling material based on the speed change amount. The detail of the speed pattern create function 40*c* will be described later.

The temperature control function 42 includes as the low-order function an initial output determination function 42*a*, a feedforward control function 42*b*, and a feedback control function 42*c*.

The initial output determination function 42*a* is a function to determine an initial flow amount of the coolant supplied from the coolers 32 and 34 based on latest speed pattern received from the setting calculation function 40.

The feedforward control function 42*b* is a function to determine a flow amount of the coolant from the cooler 32 based on a measured temperature value 52 received from the finishing mill entry-side thermometer 24 and the latest speed pattern. The feedforward control function 42*b* is also a function to determine the flow amount of the coolant from the cooler 34 based on the measured temperature value 52 received from the finishing mill delivery-side thermometer 26 and the latest speed pattern.

The feedback control function 42*c* is a function to change the flow amount of the coolant from the cooler 32 so as to correct an error between the measured temperature value 52 received from the finishing mill delivery-side temperature meter 26 and a target temperature. The feedback control function 42*c* is also a function to change the flow amount of the coolant from the cooler 34 so as to correct the error between the measured temperature value 52 received from the coiler entry-side thermometer 28 and the target temperature.

The gap change function 44 is a function to change each roll gap of the stands at timings instructed by the tracking function 48 based on each plate thickness change amount at the stands (i.e., the difference between a present target value and a next target value of the plate thickness of the rolling material set per stand) that is received from the setting calculation function 40.

The speed control function 46 is a function to adjust each rolling speed of the stands. When the roll gap of the stand is changed by the gap change function 44, the speed control function 46 adjusts the rolling speed of the same stand to keep tensions between the stands approximately constant.

The tracking function 48 is a function to track the plate thickness changing point and to activate the setting calculation function 40, temperature control function 42 and gap change function 44 at appropriate timings.

The operation instruction 50 includes at least a product dimension of the preceding material and the succeeding material (i.e., plate thickness, plate width and plate length). The operation instruction 50 includes target values of the temperature of the rolling material at various points in the hot rolling line (i.e., the target values of the finishing mill entry-side temperature, the finishing mill delivery-side temperature and the coiler approach temperature).

<Temperature Change of Rolling Material Associated with Flying Thickness Change>

As mentioned above, in the endless rolling line, the speed of the slab in the entry side of the roughing mill is governed by the casting speed. Thus, if the casting speed does not change, the speed of the slab in the entry side of the roughing mill is constant. If the casting speed is unchanged, the speed of the rolling material rolled in the mill is governed by the mass flow constant regulation established between the stands. That is, under a casting speed constant condition, when the plate thickness of the rolling material is reduced by a certain stand, the speed of the rolling material in the delivery side of the same stand becomes larger than the speed in the entry side of the same stand.

For example, consider a case where each rolling reduction rate of the stands of the finishing mill is changed in a sequential order to change the plate thickness of the strip (i.e., the product thickness) in the delivery side of the final stand of the finishing mill.

The rolling reduction rate is defined by the following equation (1).

$$r(i)=(H(i)-h(i))/H(i) \quad (1)$$

r(i): the rolling reduction rate of the stand i ($1 \le i \le n$)

H(i): the plate thickness of the rolling material in the entry side of the stand i h(i): the plate thickness of the rolling material in the delivery side of the stand i According to the mass flow constant regulation, when the rolling reduction rate of the stand i changes, the speed of the rolling material in the delivery side of the stand i changes. Since the speed of the delivery side of the stand i and that of the entry side of an adjacent stand i+1 which is located in a downstream of the stand i need to be synchronized, the speed of the rolling material in the entry side of the adjacent stand i+1 changes as well as the speed of the rolling material in the delivery side of the stand i. Furthermore, the speed of the rolling material in the delivery side of adjacent stand i+1 will also change. As a result, the speed of the rolling material in the delivery side of the finishing mill changes gradually as the speed of the rolling material changes in the respective stand.

Figure 3:
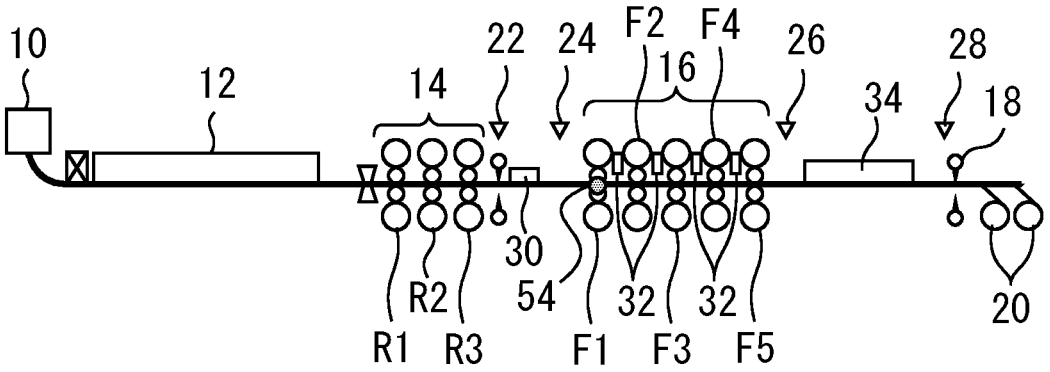
FIG. 3 is a diagram for explaining movement condition of a plate thickness changing point during rolling.
Figure 3:
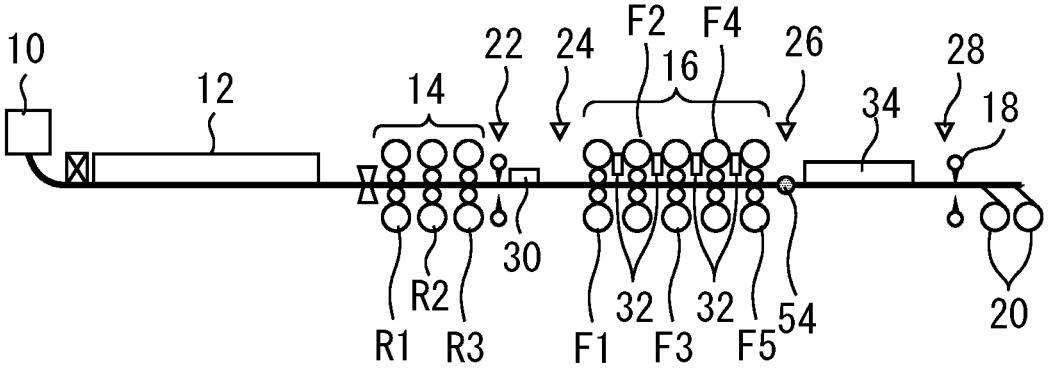
Figure 3:
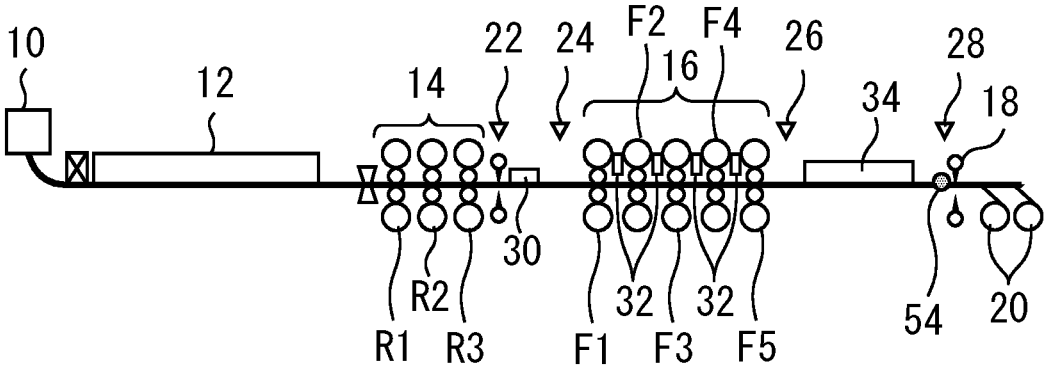
Figure 4:
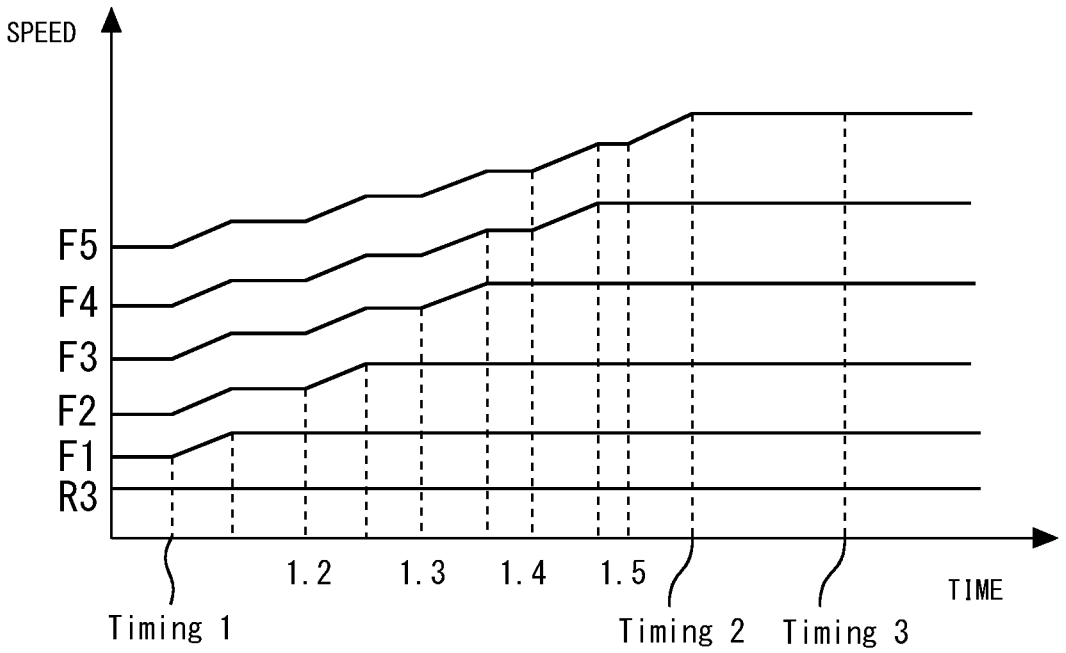
FIG. 4 is a diagram for showing speed of a slab or a rough bar (the rolling material in each delivery side of stands of a finishing mill.

Referring to FIGS. 3 to 4, it will be specifically described that the speed of the strip in the delivery side of the finishing mill changes gradually with the change of the speed of the rough bar in the respective stand of the finishing mill. FIG. 3 is a diagram for explaining movement condition of the plate thickness changing point during rolling. As shown in FIG. 3, at Timing 1, the plate thickness changing point 54 locates at the first stand F1. At Timing 2, the plate thickness changing point 54 has moved to the delivery side of the fifth stand F5. At Timing 3, the plate thickness changing point 54 has moved to just under the toiler entry-side thermometer 28.

At the Timing 1, the roll gap is narrowed in order to reduce the plate thickness of the rough bar in the delivery side of the first stand F1. Similarly, in order to reduce the plate thickness of the rolling material in each delivery side of the second stand F2 to the fifth stand F5, each roll gap of the stands is narrowed. Each roll gap of the stands is changed at each timing when the plate thickness changing point 54 is moved to each position of the second stand F2 to the fifth stand F5. FIG. 4 shows the speed of the rolling material in each delivery side of the stands when such the rolling is performed. The vertical axis of FIG. 4 represents the speed of the rolling material in each delivery side of the stands of the finishing mill.

As shown in FIG. 4, when the roll gap of the first stand F1 is narrowed at the Timing 1, each speed of the rolling material in the delivery side of the second stand F2 to the fifth stand F5 increases with mass flow constant regulation, and then becomes constant. Further, when each roll gap of the stands is narrowed at respective timings when the plate thickness changing point 54 has moved to each position of the stands, the speeds of the rolling material in the delivery sides of the stand which narrows its roll gap and the stand located downstream of the narrowing stand show the same behavior as the behavior after the Timing 1. For example, if the roll gap of the stand is narrowed at Timing 1.3 when the plate thickness changing point 54 locates at the third stand F3, the speed of the rolling material in the delivery side of the third stand F3 to the fifth stand F5 becomes fast and thereafter, either speeds become constant.

As described above, since the plate thickness and the speed of the rolling material are gradually changed, the temperature of the strip in the delivery side of the final stand is changed in a complicated manner. If the rolling reduction rate of the stand is changed to increase, as well as the change in the speed, processing heat associated with change in shape and frictional heat generated between the rolls and the rolling material are increased, thereby the temperature of the rolling material is increased. On the other hand, if the plate thickness of the rolling material decreases, surface area of the rolling material increases, so that the temperature of the rolling material tends to decrease. As just described, the temperatures of the rolling material changes in the complex manner.

<Problems Associated with Flying Thickness Change>

Figure 5:
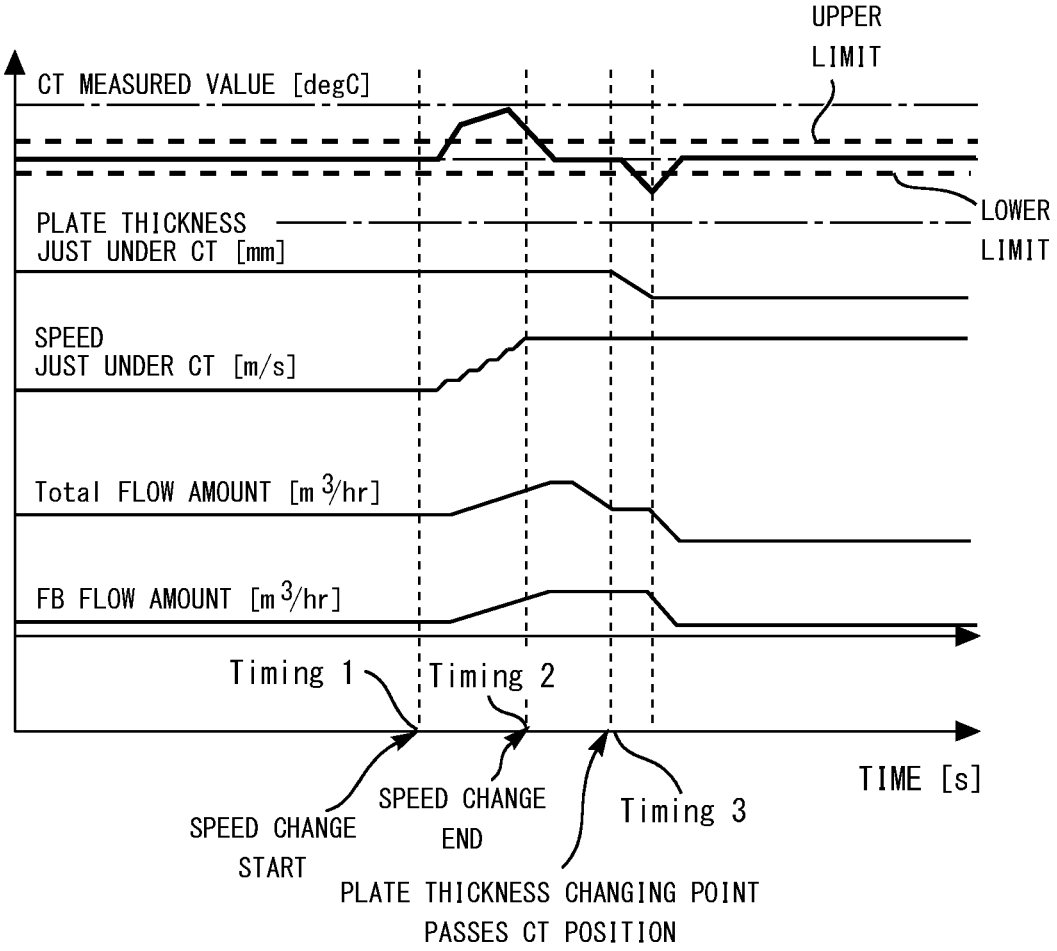
FIG. 5 is a diagram for explaining problems when plate thickness of the slab or the rough bar (the rolling material) and delivery side speed between stands are gradually changed.

FIG. 5 is a diagram for explaining problems when the plate thickness and the speed of the rolling material are gradually changed. The CT (Coiling Thermometer) measured value shown in FIG. 5 represents a measured temperature value from the coiler entry-side thermometer 28 shown in FIG. 1. The CT measured value increases because cooldown time is mainly shortened due to the increase of the speed of the rolling material in the delivery side of the final stand F5. If the feedback control is executed to increase the flow amount of the coolant, the target temperature can be achieved. However, the temperature decreases at the timing when the coolant passes through the coiler entry-side thermometer 28. This is because since the plate thickness becomes thin downstream of the plate thickness changing point, the temperature is easy to decreased whereas the flow amount of the coolant is increased to cool excessively due to a feedback control output.

The plate thickness just under CT shown in FIG. 5 represents the plate thickness of the strip just under the coiler entry-side thermometer 28. As described in FIGS. 3 to 4, at Timing 1, the plate thickness changing point is at the first stand F1. Therefore, at the Timing 1, the plate thickness just under CT is still in the same plate thickness as that before the change (the plate thickness of the preceding material). The plate thickness just under CT changes at the Timing 3 when the plate thickness changing point passes just under the coiler entry-side thermometer 28.

The speed just under CT shown in FIG. 5 represents the speed of the strip just under the coiler entry-side thermometer 28. As described with reference to FIG. 4, the speed of the strip in the delivery side of the fifth stand F5 increases gradually at the timing when each roll gap of the stands is narrowed. And, the coiler entry-side thermometer 28 locates downstream of the finishing mill 16. Therefore, the speed just under CT increases gradually from the Timing 1 to the Timing 2, as does the speed of the strip in the delivery side of the fifth stand F5.

The Total flow amount shown in FIG. 5 represents a total flow amount of the coolant from the cooler 34 shown in FIG. 1. Total flow amount reflects a correcting flow amount, i.e., the FB flow amount, based on the feedback control based on the error between the target temperature of the strip just under the coiler entry-side thermometer 28 and the CT measured value. In the example shown in FIG. 5, the FB flow amount is increased as the CT measured value increases after the Timing 1, thereby the Total flow amount is increased. However, there is a possibility that the increase in CT measured value is unable to suppress because the feedback control is delayed. Actually, in the case shown in FIG. 5, the CT measured value exceeds an upper limit immediately after the Timing 1.

Further, in the example shown in FIG. 5, the feedforward control of the flow amount of the coolant from the cooler 34 is executed in parallel with the feedback control mentioned above. In FIG. 5, since the plate thickness is reduced by the flying thickness change, the Total flow amount is changed from the Timing 2 to the Timing 3 by the execution of the feedforward control.

The feedforward control is started at a timing when the plate thickness changing point is approaching the cooler 34 (more specifically, at a timing slightly later than the Timing 2). Therefore, the Total flow amount decreases after this timing. Before this timing, however, the feedback control has been executed. Therefore, there is a possibility that the CT measured value is greatly lowered because it is strongly affected by the FB flow amount. Actually, in the case shown in FIG. 5, the CT measured value exceeds a lower limit before and after the Timing 3.

<Features of Temperature Control in First Embodiment>

Figure 6:
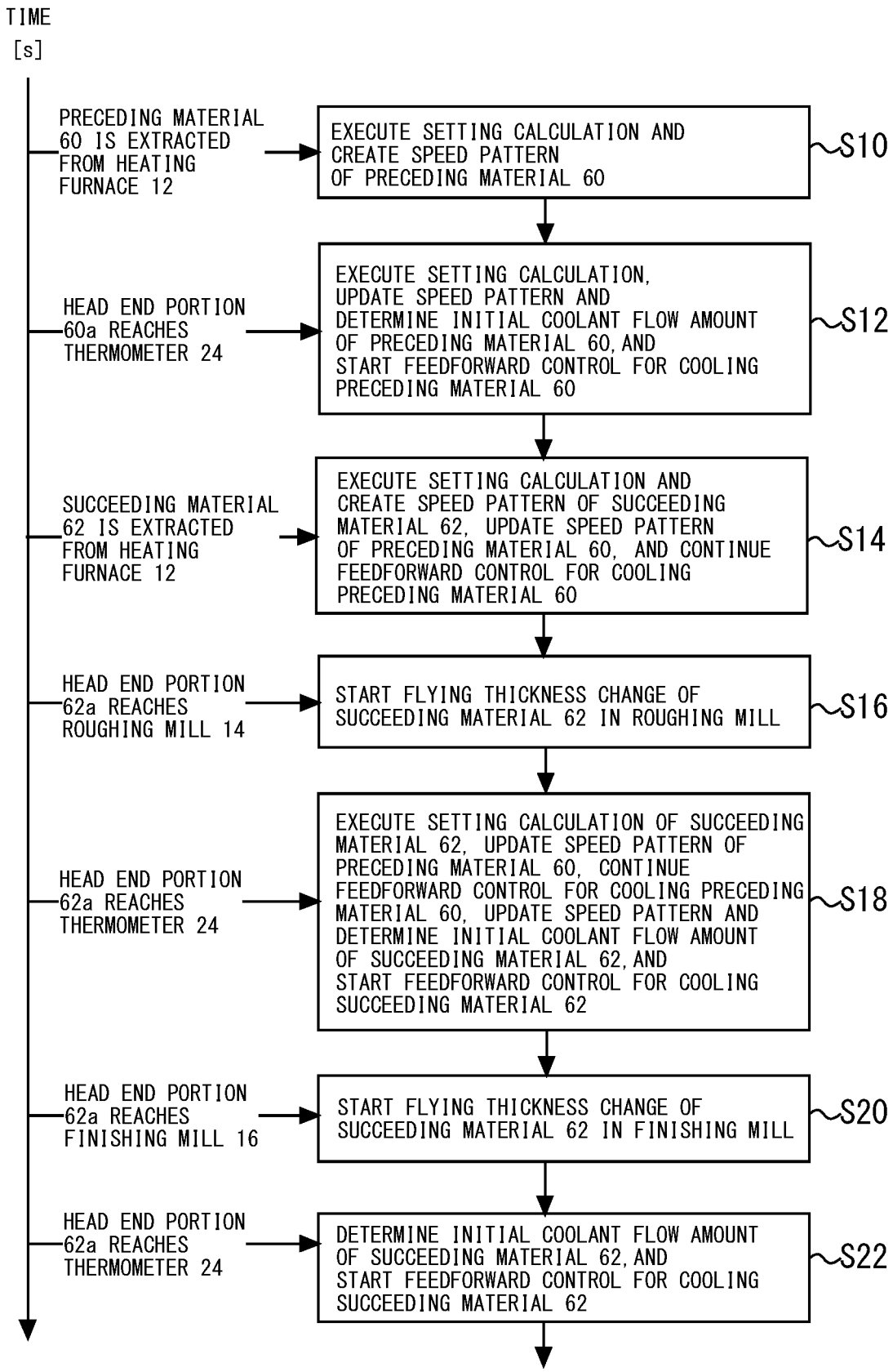
FIG. 6 is a flow chart for explaining exemplary processing when the temperature control device according to the first embodiment of the present invention executes an operation related to the flying thickness change.
Figure 7:
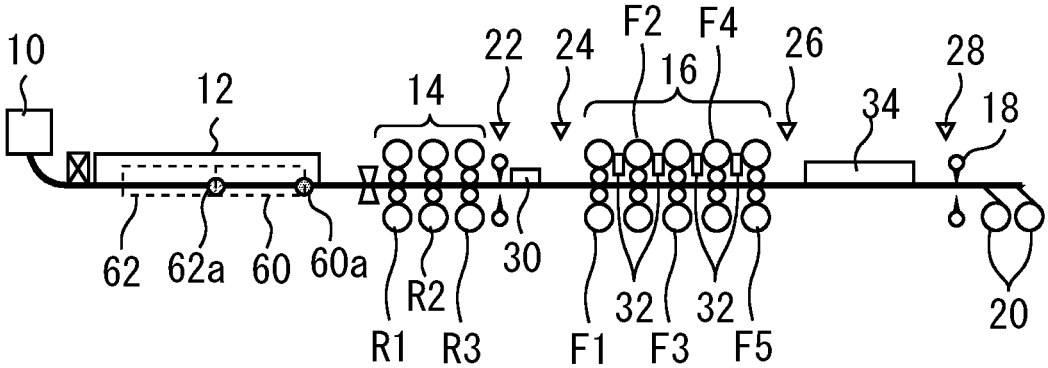
FIG. 7 is a diagram for showing the movement condition of the slab, the rough bar or a strip (the rolling material) at respective timings explained in FIG. 6.
Figure 7:
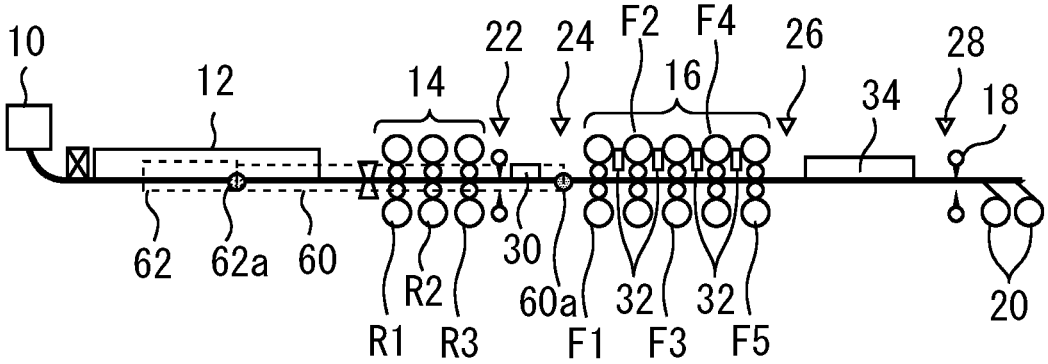
Figure 7:
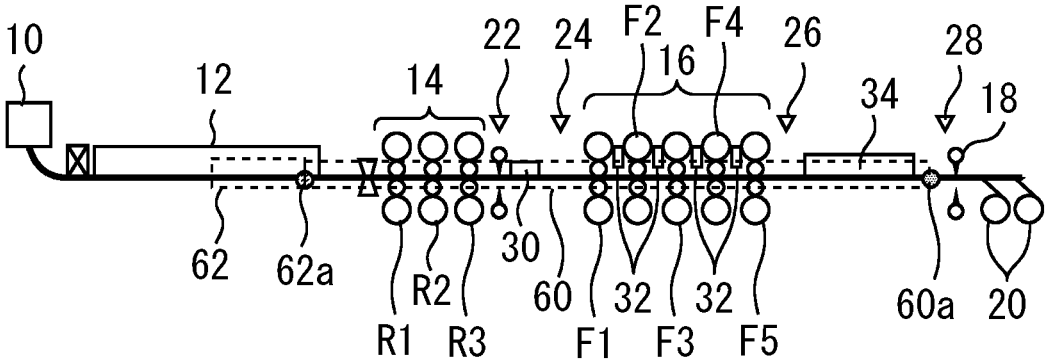
Figure 7:
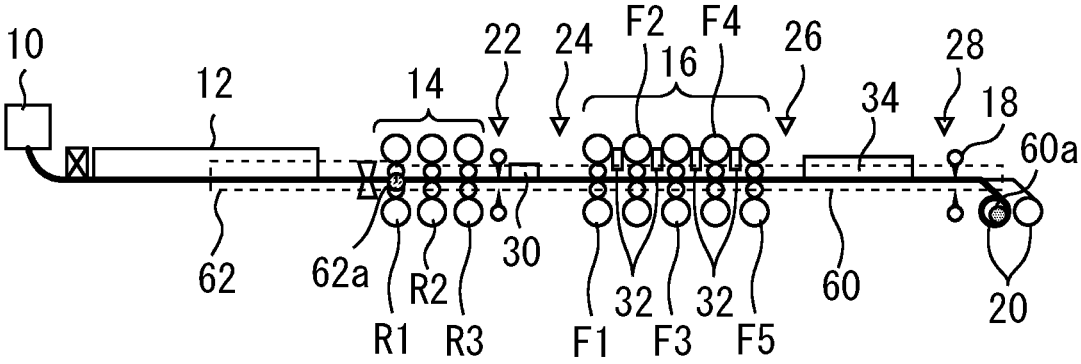
Figure 8:
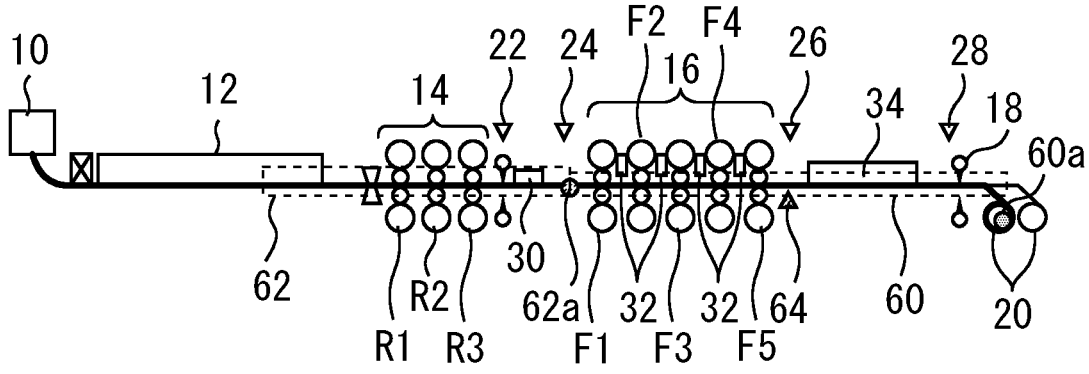
FIG. 8 is a diagram for showing the movement condition of the slab, the rough bar or the strip (the rolling material) at the respective timings explained in FIG. 6.
Figure 8:
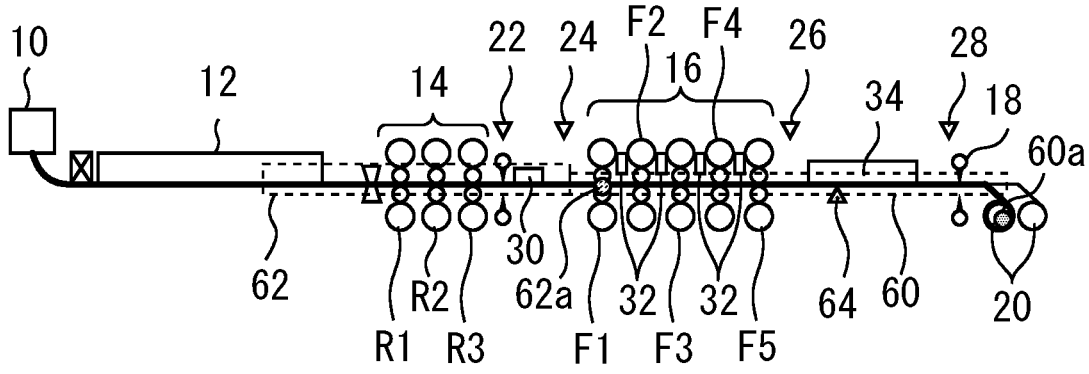
Figure 8:
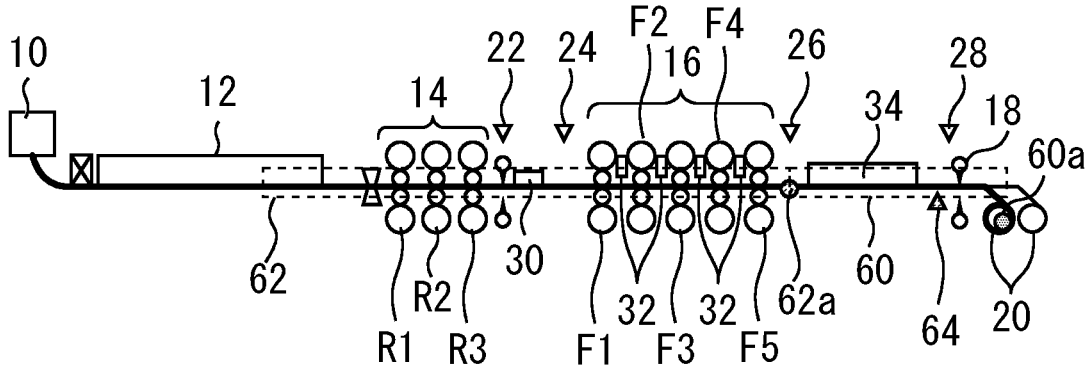

Therefore, in the temperature control device according to the first embodiment, the temperature control described below is executed by using the configuration shown in FIG. 2. This temperature control will be described with reference to FIGS. 6 to 8. FIG. 6 is a flow chart for explaining exemplary processing when the temperature control device according to the first embodiment of the present invention executes an operation related to the flying thickness change. FIGS. 7 and 8 are diagrams for showing the movement condition of the rolling material at respective timings explained in FIG. 6. In FIGS. 6 to 8, it is assumed that a preceding material 60 and a succeeding material 62 are present in a single rolling material, and the target plate thicknesses in the delivery side of the finishing mill 16 differ in each other.

As shown in FIG. 6, the temperature control device first executes setting calculation of the preceding material 60 at the timing when the preceding material 60 is extracted from the heating furnace 12 (see Timing 6.1 in FIG. 7) (step S10). Specifically, the temperature control device calculates the plate thickness schedule and the plate thickness changing time of the preceding material 60 by the flying thickness change amount determination function. The temperature control device also calculates, based on the plate thickness schedule, the speed change amount by the speed change amount calculation function. Then, the temperature control device creates, based on the speed change amount, the speed pattern of the preceding material 60 by the speed pattern create function.

Subsequent to the step S10, the temperature control device executes the setting calculation of the preceding material 60 at the timing when the head end portion 60*a* of the preceding material 60 reaches the finishing mill entry-side thermometer 24 (see Timing 6.2 in FIG. 7) (step S12). Specifically, the temperature control device calculates the plate thickness schedule and the plate thickness changing time of the preceding material 60 by the flying thickness change amount determination function. The temperature control device also calculates, based on the plate thickness schedule, the speed change amount by speed change amount calculation function. Then, the temperature control device updates, based on the speed change amount, the speed pattern of the preceding material 60 by the speed pattern create function (a first update).

In addition, the temperature control device determines an initial flow amount by the initial output determination function based on the speed pattern of the first updating preceding material 60. The initial flow amount is an initial value of the flow amount of the coolant supplied from the cooler 32 and 34 to cool the preceding material 60. Then, the temperature control device starts to execute the feedforward control of the amount of the coolant supplied from the cooler 32 and 34 by the feedforward control function based on the initial flow amount.

Subsequent to the step S12, the temperature control device executes the setting calculation of the succeeding material 62 at the timing when the succeeding material 62 is extracted from the heating furnace 12 (see Timing 6.3 in FIG. 7) (step S14). If the target plate thicknesses in the delivery side of the roughing mill 14 differ between the preceding material 60 and the succeeding material 62, the temperature control device calculates the plate thickness schedule and the plate thickness changing time of the succeeding material 62 by the flying thickness change amount determination function. The temperature control device also calculates the speed change amount by speed change amount calculation function based on the plate thickness schedule. Then, the temperature control device creates the speed pattern of the succeeding material 62 by the speed pattern create function based on the speed change amount and updates the speed pattern of the preceding material 60 (second update).

The temperature control device also continues to execute the feedforward control of the amount of the coolant supplied from the cooler 32 by the feedforward control function based on the speed pattern of the second updating preceding material 60 and the measured temperature value from the finishing mill entry-side thermometer 24. In addition, the temperature control device continues to execute the feedforward control of the amount of the coolant supplied from the cooler 34 by the feedforward control function based on the updated speed pattern of the preceding material 60 and the measured temperature value from the finishing mill delivery-side thermometer 26.

Subsequent to the step S14, the temperature control device starts the flying thickness change in the roughing mill at the timing when the head end portion 62*a* of the succeeding material 62 reaches the entry side of the first stand R1 (see Timing 6.4 in FIG. 7) (step S16). Specifically, the temperature control device changes the roll gap of the first stand R1 by the gap change function based on the plate thickness schedule of the succeeding material 62. The same processing executed in the step S16 is also executed at respective timings when the head end portion 62*a* reaches each entry side of the second stand R2 and the third stand R3.

In addition, the temperature control device adjusts each rolling speed of stands by the speed control function at respective timing when the roll gaps of the first stand R1 to the third stand R3 are changed. However, the changes in the speed of the rolling material associated with the adjustments of this rolling speed have been considered in the updating of the speed pattern of the preceding material 60 by the speed pattern create function and in the feedforward control executed based on the same speed pattern. That is, the feedforward control is executed while anticipating the temperature change of the rolling material due to the adjustment of the rolling speed by the speed control function.

If the target plate thickness in the delivery side of the roughing mill 14 does not change between the preceding material 60 and the succeeding material 62, the processing of the steps S14 and S16 are not executed.

Subsequent to the step S16, the temperature control device executes the setting calculation of the succeeding material 62 at the timing when the head end portion 62*a* reaches the finishing mill entry-side thermometer 24 (see Timing 6.5 in FIG. 8) (step S18). Specifically, the temperature control device calculates the plate thickness schedule and the plate thickness changing time of the succeeding material 62 by the flying thickness change amount determination function. The temperature control device also calculates the speed change amount by the speed change amount calculation function based on the plate thickness schedule. Then, the temperature control device updates the speed pattern of the preceding material 60 by the speed pattern create function based on the speed change amount (a third update), and updates the speed pattern of the succeeding material 62.

In addition, the temperature control device continues to execute the feedforward control of the amount of the coolant supplied from the cooler 34 by the feedforward control function based on the speed pattern of the third updating preceding material 60 and the measured temperature value from the finishing mill delivery-side thermometer 26. In addition, the temperature control device determines the initial flow amount by the initial output determination function based on the updated speed pattern of the succeeding material 62. The initial flow amount is the initial value of the flow amount of the coolant supplied from the cooler 32 to cool the succeeding material 62. Then, the temperature control device starts to execute the feedforward control of the amount of the coolant supplied from the cooler 32 by the feedforward control function based on the initial flow amount.

Subsequent to the step S18, the temperature control device starts the flying thickness change in the finishing mill at the timing when the head end portion 62*a* reaches the entry side of the first stand F1 of the finishing mill 16 (see Timing 6.6 in FIG. 8) (step S20). Specifically, the temperature control device changes the roll gap of the first stand F1 by the gap change function based on the plate thickness schedule of the succeeding material 62 in the finishing mill 16. The same processing executed in the step S20 is also executed at respective timings when the head end portion 62*a* reaches each entry side of the second stand F2 to the fifth stand F5.

In addition, the temperature control device adjusts by the speed control function each rolling speed of the stands at each timing when the roll gaps of the first stand F1 to the fifth stand F5 are changed. However, the changes in the speed of the rolling material associated with the adjustment of the rolling speed have been considered in the updating of the speed patterns of the preceding material 60 and the succeeding material 62 by the speed pattern create function and in the feedforward control based on these speed patterns. That is, the feedforward control is executed while anticipating the temperature change of the rolling material due to the adjustment of the rolling speed by the speed control function.

Subsequent to the step S20, the temperature control device determines the initial flow amount by the initial output determination function based on the speed pattern of the latest succeeding material 62 at the timing to reach the finishing mill delivery-side thermometer 26 (see Timing 6.7 in FIG. 8) (step S22). The initial flow amount is the initial value of the flow amount of the coolant supplied from the cooler 34 to cool the succeeding material 62. Then, the temperature control device starts to execute the feedforward control of the amount of the coolant supplied from the cooler 34 by the feedforward control function based on the initial flow amount.

Note that the temperature control device executes the feedback control by the feedback control function during the steps S10 to S22. Specifically, the temperature control device executes the feedback control by the feedback control function based on the error between the measured temperature value from the finishing mill delivery-side temperature meter 26 and its target value. The temperature control device also executes the feedback control by the feedback control function based on the error between the measured temperature value from the coiler entry-side thermometer 28 and its target value. The measured temperature value from the finishing mill delivery-side thermometer 26 may be disturbed as the plate thickness changing point passes just under the finishing mill delivery-side thermometer 26. The same applies to the measured temperature value from the coiler entry-side thermometer 28. In such cases, the temperature control device temporarily holds the feedback output to keep the flow amount of the coolant from the cooler 32 or 34 constant.

<Speed Change Amount Calculation Function>

Next, a predictive calculation method of the speed change amount by the speed change amount calculation function will be described.

The mass flow constant regulation prior to the flying thickness change is expressed by the following equation (2).

$$v(E)h(E)=v(0)^A h(0)^A = \ . \ . \ . \ = v(i)^A h(i)^A = v(i+1)^A h(i+1)^A = \ . \ . \ . \ = v(n)^A h(n)^A \quad (2)$$

v(E): the casting speed [m/s]

h(E): the plate thickness of the slab [m]

$v(i)^A$: the speed of the rolling material in the delivery side of the stand i [m/s]

$h(i)^A$: the plate thickness of the rolling material in the delivery side of the stand i [m]

$v(n)^A$: the speed of the strip in the delivery side of the final stand n [m/s]

$h(n)^A$: the plate thickness of the strip in the delivery side of the final stand n [m]

The mass flow constant regulation after the flying thickness change is completed in all of the stands is expressed by the following equation (3).

$$v(E)h(E)=v(0)^B h(0)^B = \ . \ . \ . \ = v(i)^B h(i)^B = v(i+1)^B h(i+1)^B = \ . \ . \ . \ = v(n)^B h(n)^B \quad (3)$$

$v(i)^B$: the speed of the rolling material in the delivery side of the stand i [m/s]

$h(i)^B$: the plate thickness of the rolling material in the delivery side of the stand i [m]

$v(n)^B$: the speed of the strip in the delivery side of the final stand n [m/s]

$h(n)^B$: the plate thickness of the strip in the delivery side of the final stand n [m]

The casting speed remains unchanged before and after the flying thickness change. Therefore, the following relationships (4) and (5) are derived from the equations (2) and (3).

$$v(n)^A h(n)^A = v(n)^B h(n)^B = v(i)^B h(i)^B \quad (4)$$

$$\Leftrightarrow (v(i)^B / h(n)^A) = (v(n)^A / h(i)^B) \quad (5)$$

After the completion of the flying thickness change at a stand j (i≤j≤n), and in a situation where the plate thickness changing point locates between the stand j and a stand j+1, the speed of the rolling material in the entry side of the stand j+1 changes from $v(j)^A$ to v(j)B in accompany with the change of the speed of the rolling material in the delivery side of the stand j. However, the plate thickness changing point does not reach the entry side of the stand j+1. Therefore, the plate thickness $H(j+1)^A$ of the rolling material in the entry side of the stand j+1 is equal to the plate thickness $h(j)^A$ prior to the flying thickness change. Focusing on this, the mass flow constant regulation which is established, at the timing when the plate thickness changing point locates between the stand j and the stand j+1, among the entry side of the stand j+1, the delivery side of stand j+1, and each delivery side of the stands located downstream of the stand j+1 is expressed by the following equation (6).

$$v(j)^B h(j)^A = v(j+1)^{A(j)} h(j+1)^A = \ . \ . \ . \ = v(n)^{A(j)} h(n)^A \quad (6)$$

$v(j+1)^{A(j)}$: the speed of the rolling material in the delivery side of the stand j+1 at the timing when the plate thickness changing point locates between the stand j and the stand j+1 [m/s]

$v(n)^{A(j)}$: the speed of the rolling material in the delivery side of the final stand n at the timing when the plate thickness changing point locates between the stand j and the stand j+1 [m/s]

Figure 9:
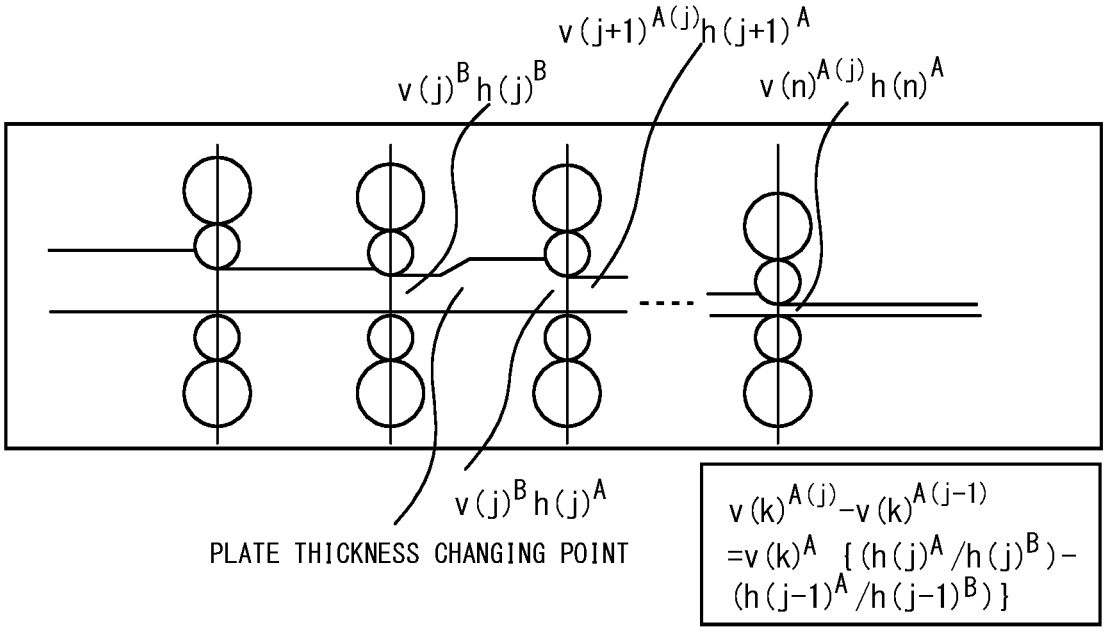
FIG. 9 is a diagram for explaining Equation (6).

FIG. 9 is a diagram for explaining the equation (6). As explained above, in the situation where the plate thickness changing point locates between the stand j and the stand j+1, the speed of the rolling material in the entry side of the stand j+1 is equal to $v(j)^B$, and the plate thickness H(j+1)A in the entry side of the stand j+1 is equal to the plate thickness H(j)A of the rolling material in the delivery side of the stand j. Therefore, the mass flow in the entry side of the stand j+1 is expressed by $v(j)^B h(j)^A$. Then, the mass flow $v(j)^B h(j)^A$ is equal to the mass flow $(j+1)^{A(j)}\ h(j+1)^A$ in the delivery side of stand j+1, and is also equal to the mass flow $v(n)^{A(j)}\ h(n)^A$ in the delivery side of the final stand n.

The relation of the equation (6) holds even when the plate thickness changing point is between the stand j−1 and the stand j. Specifically, the mass flow constant regulation which is established, at the timing when the plate thickness changing point locates between the stand j−1 and the stand j, among the entry side of the stand j, the delivery side of stand j, and each delivery side of the stands located downstream of the stand j is expressed by the following equation (7).

$$v(j-1)^B h(j-1)^A = v(j)^{A(j-1)} h(j)^A = \ldots = v(n)^{A(j-1)} h(n)^A \tag{7}$$

From the equations (6) and (7), the speed change amount of the rolling material in the delivery side of a stand k (j≤k≤n) in a case where the plate thickness changing point moves from the entry side to the delivery side of the stand j is expressed as follows:

$$\begin{aligned} v(k)^{A(j)} - v(k)^{A(j-1)} &= (h(j)^A / h(k)^A) v(j)^B - (h(j-1)^A / h(k)^A) v(j-1)^B \\ &= h(j)^A (v(k)^A h(j)^B) - h(j-1)^A (v(k)^A h(j-1)^B) \\ &\quad \text{(from the equation (5))} \\ &= v(k)^A ((h(j)^A / h(j)^B) - v(k)^A (h(j-1)^A / h(j-1)^B)) \\ &= v(k)^A \left\{ \begin{matrix} (h(j)^A / h(j)^B) - \\ (h(j-1)^A / h(j-1)^B) \end{matrix} \right\} \end{aligned} \tag{8}$$

$v(k)^{A(j)}$: the speed of the rolling material in the delivery side of the stand k at the timing when the plate thickness changing point locates between the stand j and the stand j+1 [m/s]

$v(k)^{A(j-1)}$: the speed of the rolling material in the delivery side of the stand k at the timing when the plate thickness changing point locates between the stand j−1 and the stand j [m/s]

<Speed Pattern Create Function>

Next, the speed pattern which is created or updated by the speed pattern create function will be described.

Figure 10:
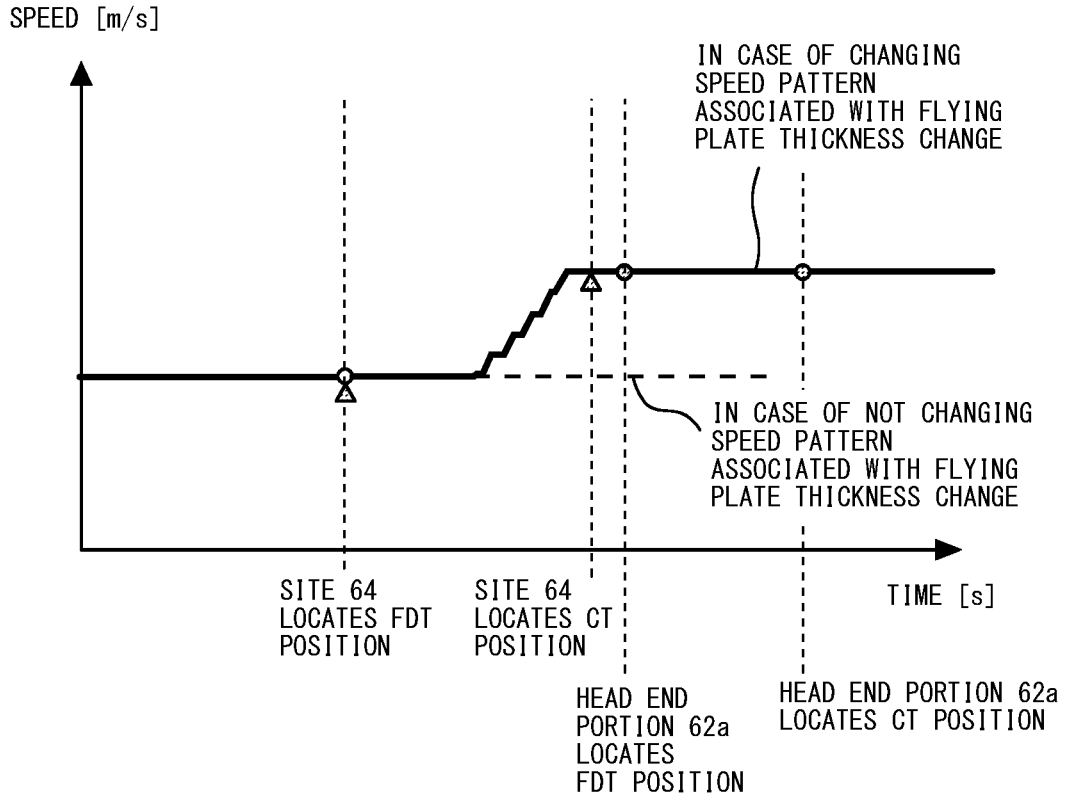
FIG. 10 is a diagram for showing an exemplary speed pattern created or updated by a speed pattern create function.

FIG. 10 is a diagram for showing an exemplary speed pattern created or updated by the speed pattern create function. The CT position shown in FIG. 10 represents the position of the coiler entry-side thermometer 28 shown in FIG. 1. The FDT (Finishing mill Delivery Thermometer) position shown in FIG. 10 represents the position of the finishing mill delivery-side thermometer 26 shown in FIG. 1. The site 64 shown on the horizontal axis of FIG. 10 is a site of the preceding material 60 located at the FDT position when the head end portion 62*a* reaches the finishing mill entry-side thermometer 24 (see Timing 6.5 shown in FIG. 8). The site 64 is also depicted in Timings 6.6 and 6.7 shown in FIG. 8.

The solid line shown in FIG. 10 represents a speed history of the site 64 when the change in the speed of the rolling material due to the flying thickness is predicted and incorporated into the speed pattern. As shown by the solid line, the speed of the rolling material at the timing when the site 64 locates at the FDT position is constant. However, as described in the explanation of the step S18 shown in FIG. 7, at the Timing 6.5 shown in FIG. 8, the setting calculation of the succeeding material 62 is executed and the speed pattern of the preceding material 60 is updated. Therefore, from the timing after the site 64 passes the FDT position, the speed of the site 64 starts to increase gradually. Further, as described in the explanation of the step S22 shown in FIG. 7, the head end portion 62*a* reaches the delivery side of the finishing mill 16 at the Timing 6.7 shown in FIG. 8. That is, at the Timing 6.7 of FIG. 8, the flying thickness change in all of the stands of the finishing mill 16 is completed. Therefore, the speed of the site 64 becomes constant again from the timing slightly before the site 64 reaches the CT position.

The broken line shown in FIG. 10 represents the speed history of the site 64 when the change in the speed of the rolling material due to the flying thickness change is not incorporated into the speed pattern. As shown by the dashed line, the speed of the site 64 remains constant unless the change in the speed of the rolling material is incorporated into the speed pattern. Therefore, the temperature of the site 64 shifts to an unexpected temperature range.

<Advantageous Effects of Temperature Control According to First Embodiment>

Figure 11:
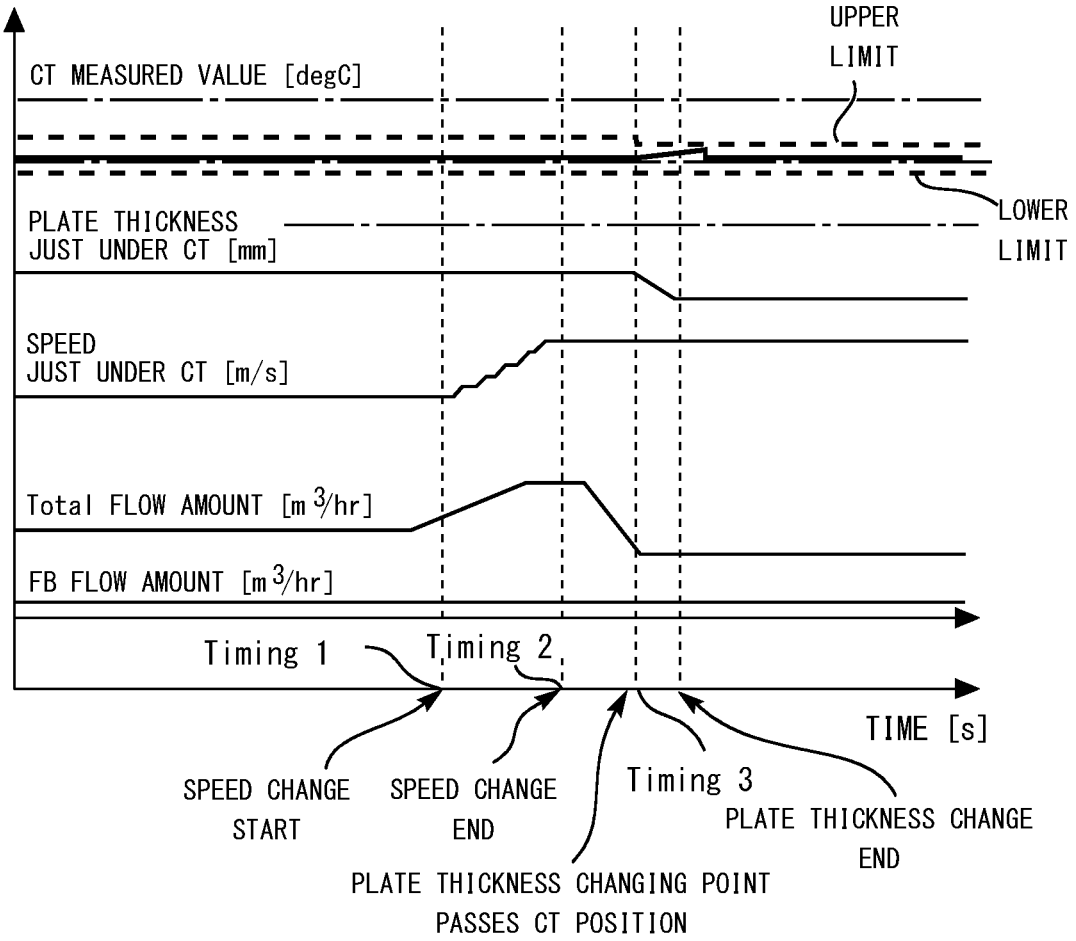
FIG. 11 is a diagram for illustrating advantageous effects of temperature control according to the first embodiment of the present invention.

FIG. 11 is a diagram for illustrating advantageous effects of the temperature control according to the first embodiment of the present invention. The CT measured value, the plate thickness just under CT, the speed just under CT, the Total flow amount and the FB flow amount shown in FIG. 11 are as described with reference to FIG. 5.

As can be seen by comparing FIG. 5 with FIG. 11, in the temperature control of the first embodiment, the Total flow amount starts to increase before the Timing 1, and the Total flow amount is greatly decreased after the Timing 2. This is because the feedforward control in which the change in the speed of the rolling material is incorporated into the speed pattern has been executed before the Timing 1. Therefore, in FIG. 11, the FB flow amount remains almost unchanged, and the Total flow amount is adjusted by the feedforward control while the plate thickness changing point passes through the finishing mill. By the adjustment of the Total flow amount, the CT measured value is controlled between the upper limit and the lower limit.

As described above, according to the temperature control device of the first embodiment, the temperature of the strip at the coiler entry-side thermometer 28, that is, the temperature of the strip immediately before winding by the coiler 20 can be controlled within the permissible range with high accuracy.

In the first embodiment mentioned above, the finishing mill 16 corresponds to the "mill" of the present invention. The coolers 32 and 34 correspond to the "heat exchanger" of the present invention. The finishing mill delivery-side temperature meter 26 and the coiler entry-side thermometer 28 correspond to the "delivery-side thermometer" of the present invention. The finishing mill entry-side thermometer 24 corresponds to the "entry-side thermometer" of the present invention if the finishing mill delivery-side temperature meter 26 corresponds to the "delivery-side thermometer". The finishing mill delivery-side temperature meter 26 corresponds to the "entry-side thermometer" if the coiler entry-side thermometer 28 corresponds to the "delivery-side thermometer".

Modification of First Embodiment

Incidentally, in the temperature control of the first embodiment mentioned above, the amount of the coolant from the cooler 32 and 34 shown in FIG. 1 was controlled by setting these coolers as controlled objects of the feedforward control. However, number of the controlled objects of the feedforward control may be reduced to set only the cooler 34 as the controlled object. In this instance, the feedforward control may be executed in which the amount of the coolant from the cooler 34 is controlled based on the measured temperature value from the finishing mill delivery-side temperature meter 26 and the latest speed pattern. On the contrary, the number of the controlled objects of the feedforward control may be increased to add the heat exchanger 30 as the controlled object. In this instance, the feedforward control may be executed in which the amount of the coolant or the amount of heat from the heat exchanger 30 is controlled based on the measured temperature value from the roughing mill delivery-side thermometer 22 and the latest speed pattern.

The temperature control of the first embodiment mentioned above is executed to control the temperature of the strip in the permissible range immediately before the winding by the coiler 20. Therefore, this object can be achieved if the amount of the coolant from the cooler 34 located immediately upstream of the coiler 20 is controlled at least by the feedforward control. Therefore, the temperature control of the first embodiment can be modified in various ways, as long as the amount of the coolant from the cooler 34 is controlled at least by the feedforward control.

Further, in the temperature control of the first embodiment mentioned above, the temperature of the strip immediately before the winding by the coiler 20 was controlled within the permissible range. However, the temperature of the rolling material controlled within the permissible range is not limited to the temperature immediately before the winding by the coiler 20. That is, the temperature of the strip in the delivery side of the finishing mill 16 may be controlled within the permissible range. The temperature of the rough bar in the entry side of the finishing mill 16 may be controlled within the permissible range.

Figure 12:
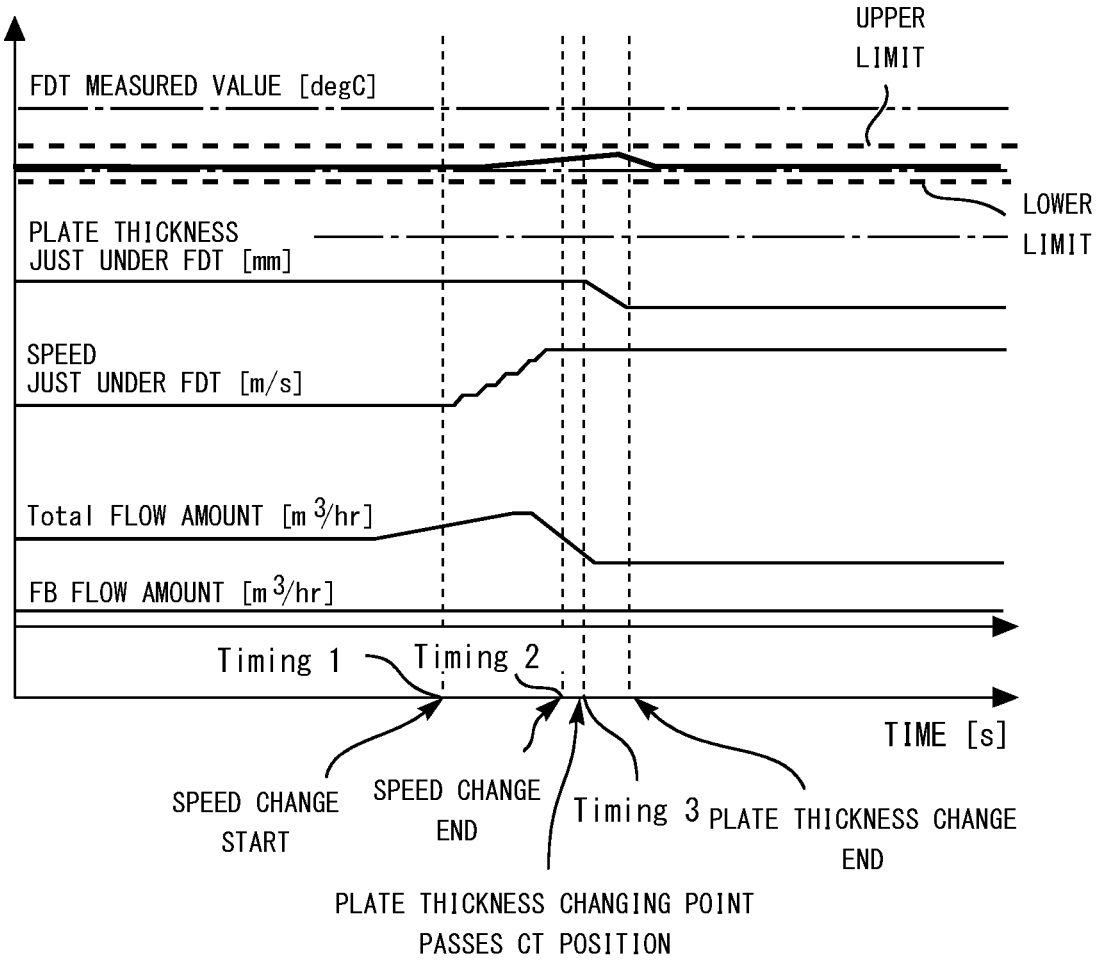
FIG. 12 is a diagram for explaining an exemplary temperature control in which temperature of the strip in the delivery side of the finishing mill is controlled within a permissible range temperature.
Figure 13:
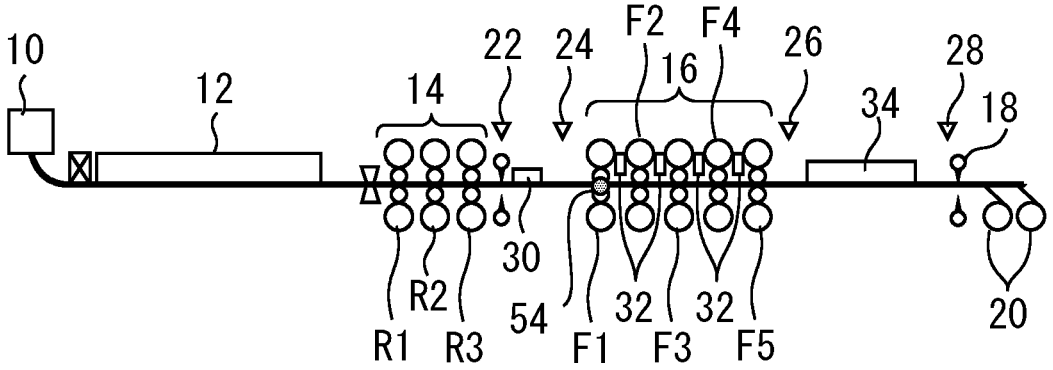
FIG. 13 is a diagram for explaining Timings 1 to 3 shown in FIG. 12.
Figure 13:
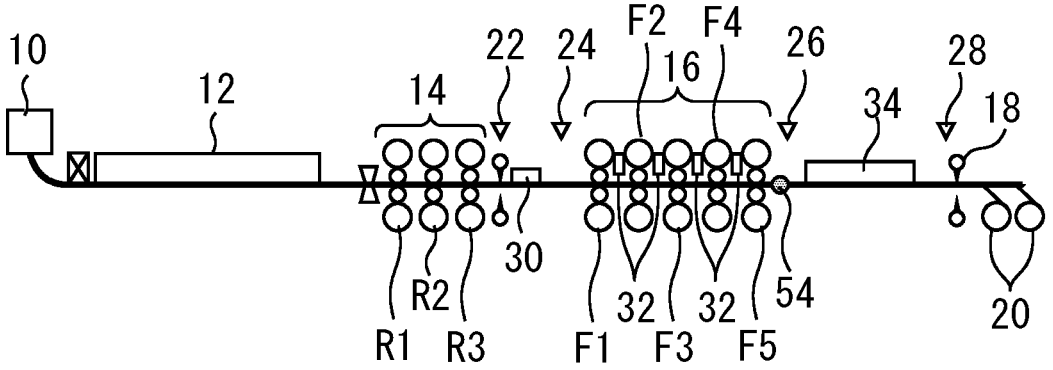
Figure 13:
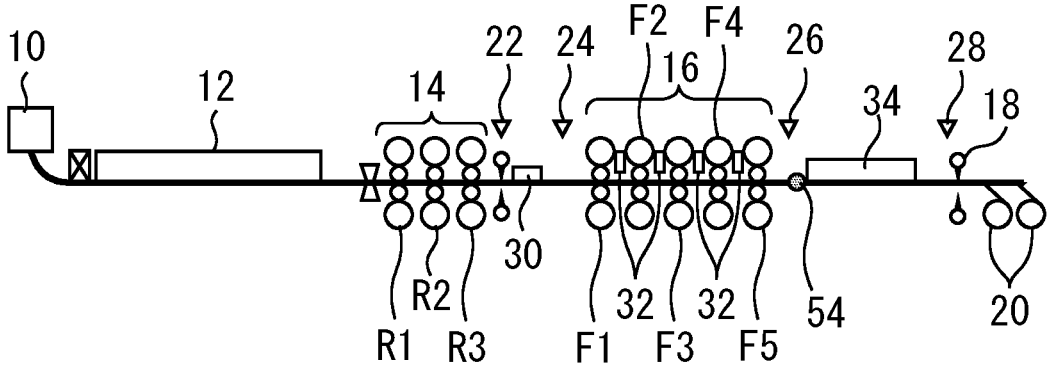

In the case where the temperature of the strip in the delivery side of the finishing mill 16 is controlled within the permissible range temperature, the amount of the coolant from the cooler 32 may be controlled at least by the feedforward control. FIG. 12 is a diagram for explaining an exemplary temperature control in which the temperature of the strip in the delivery side of the finishing mill 16 is controlled within the permissible range temperature. FIG. 13 is a diagram for explaining Timings 1 to 3 shown in FIG. 12.

The FDT measured value shown in FIG. 12 represents the measured temperature value from the finishing mill delivery-side temperature meter 26 shown in FIG. 13. The plate thickness just under FDT represents the plate thickness of the strip just under the finishing mill delivery-side temperature meter 26. The speed just under FDT represents the speed of the strip just under the finishing mill delivery-side temperature meter 26. The Total flow amount represents the total flow amount of the coolant supplied from the cooler 32 shown in FIG. 13.

As shown in FIG. 13, at the Timing 1, the plate thickness changing point 54 locates at the first stand F1. At the Timing 2, the plate thickness changing point 54 has moved to the delivery side of the fifth stand F5. At the Timing 3, the plate thickness changing point 54 has moved to just under the finishing mill delivery-side thermometer 26.

In the temperature control of this modification, the Total flow amount starts to increase before the Timing 1, and the Total flow amount decreases after the Timing 2. This is because the feedforward control in which the change in the speed of the rolling material is incorporated into the speed pattern has been executed before the Timing 1. Therefore, in FIG. 12 the FB flow amount (i.e. the correcting flow amount based on the feedback control based on the error between the measured temperature value of the finishing mill delivery-side temperature meter 26 and its target value) remains almost unchanged and the FB flow amount is adjusted by the feedforward control while the plate thickness changing point passes through the finishing mill. By the adjustment of the Total flow amount, the FDT measured value is controlled between the upper limit and the lower limit.

Figure 14:
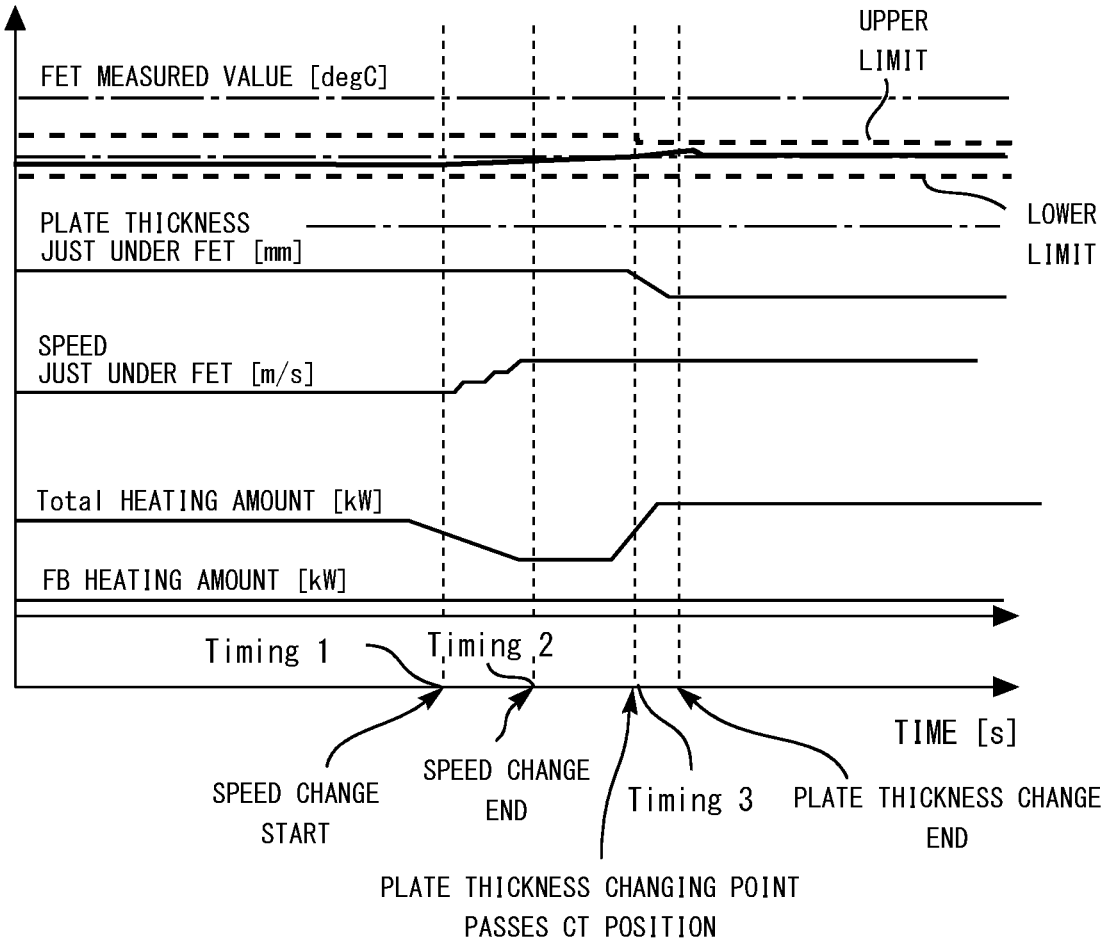
FIG. 14 is a diagram for explaining an exemplary temperature control in which the temperature of the rough bar in the entry side of the finishing mill is controlled within a permissible range temperature.
Figure 15:
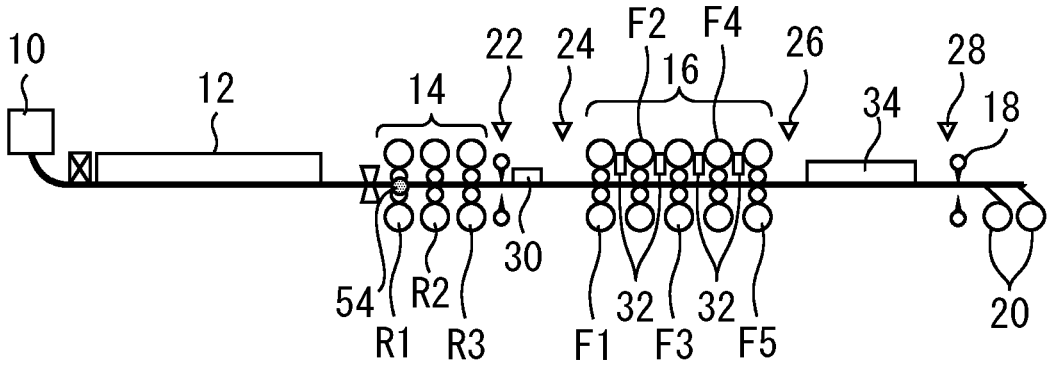
FIG. 15 is a diagram for explaining Timings 1 to 3 shown in FIG. 14.
Figure 15:
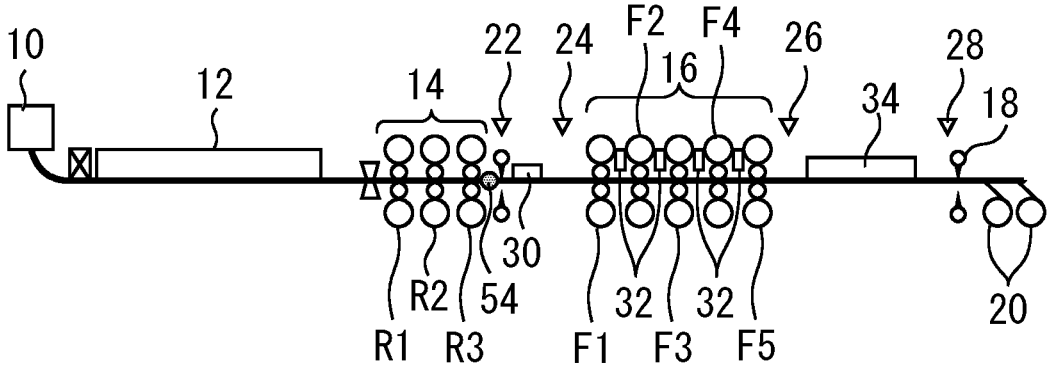
Figure 15:
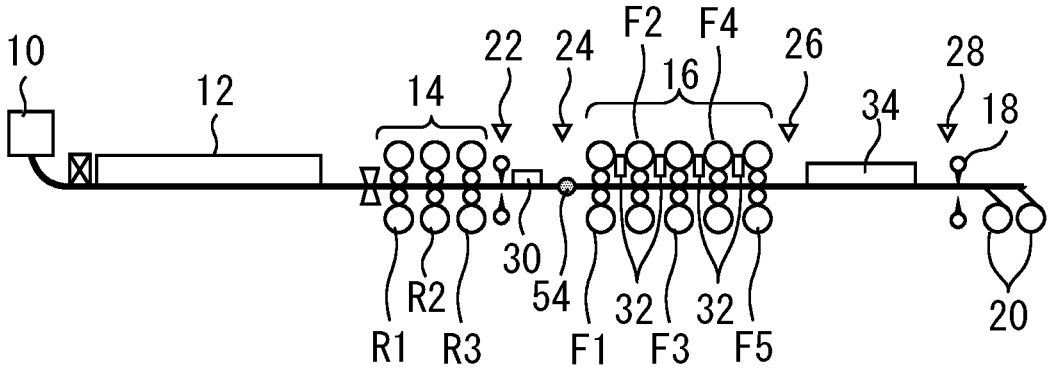

In the case where the temperature of the rough bar in the entry side of the finishing mill 16 is controlled within the permissible range, the amount of the coolant or the amount of heat from the heat exchanger 30 may be controlled by the feedforward control. FIG. 14 is a diagram for explaining an exemplary temperature control in which the temperature of the rough bar in the entry side of the finishing mill 16 is controlled within the permissible range temperature. FIG. 15 is a diagram for explaining the Timings 1 to 3 shown in FIG. 14.

The FET (Finishing mill Entry Thermometer) measured value shown in FIG. 14 represents the measured temperature value from the finishing mill entry-side thermometer 24 shown in FIG. 15. The plate thickness just under the FET represents the plate thickness of the rough bar just under the finishing mill entry-side thermometer 24. The FET-down speed represents the speed of the rough bar just under the finishing mill entry-side thermometer 24. The Total heating amount represents the amount of heat supplied from the heat exchanger 30 shown in FIG. 15.

As shown in FIG. 15, at the Timing 1, the plate thickness changing point 54 locates at the first stand R1. At the Timing 2, the plate thickness changing point 54 has moved to the delivery side of the third stand R3. At the Timing 3, the plate thickness changing point 54 has moved to just under the finishing mill entry-side thermometer 24.

In the temperature control of this modification, the Total heating amount starts to decrease before the Timing 1 and the Total heating amount is kept constant before the Timing 2. This is because the feedforward control in which the change in the speed of the rough bar is incorporated into the speed pattern has been executed before the Timing 1. Therefore, in FIG. 14, the FB heating amount (i.e., the correction heating amount based on the feedback control based on the error between the measured temperature value of the finishing mill entry-side thermometer 24 and its target value) remains almost unchanged, and the Total heating amount is adjusted by the feedforward control while the plate thickness changing point passes through the roughing mill. By the adjustment of the Total heating amount, the FET measured value is controlled between the upper limit and the lower limit.

Second Embodiment

Next, a second embodiment of the present invention will be described with reference to FIGS. 16 to 17. Note that descriptions overlapping with the first embodiment are omitted as appropriate.

<Configuration Temperature Control Device>

Figure 16:
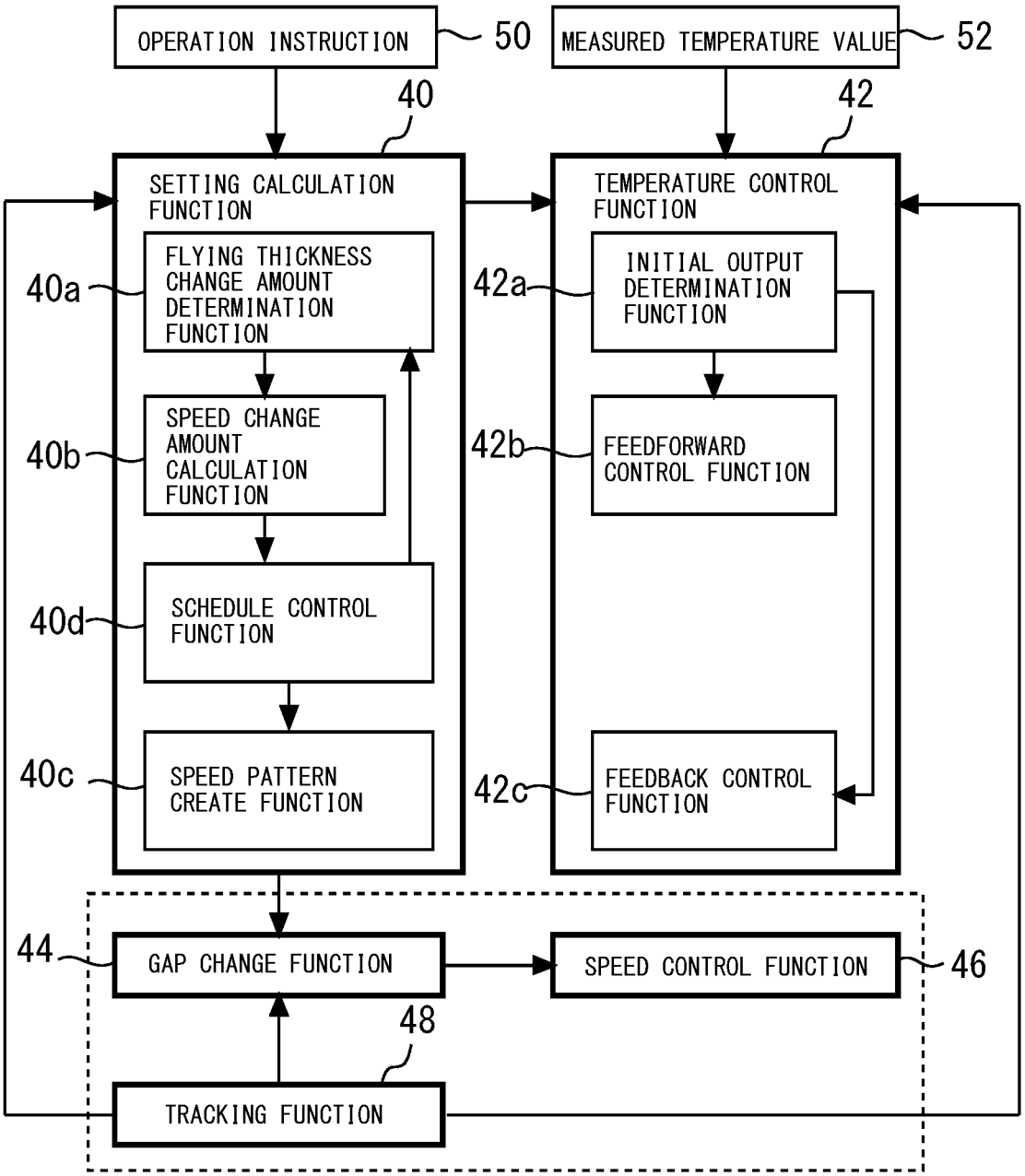
FIG. 16 is a block diagram for explaining an exemplary configuration of the temperature control device according to a second embodiment of the present invention.

FIG. 16 is a block diagram for explaining an exemplary configuration of the temperature control device according to a second embodiment of the present invention. The temperature control device shown in FIG. 16 has a setting calculation function 40, temperature control function 42, gap change function 44, speed control function 46 and a tracking function 48 as main functions. These functions are as described with reference to FIG. 2.

The temperature control device according to the second embodiment differs from the temperature control device according to the first embodiment in that the setting calculation function 40 comprises a schedule control function 40*d*.

The schedule control function 40*d* is a function to determine for each stand whether or not change rate of the rolling material which is calculated based on the speed change amount by the speed change amount calculation function 40*b* exceeds a threshold value. The schedule control function 40*d* is also a function to reduce a change amount of the plate thickness of the rolling material in the stand to be determined when it is determined in the same stand that the speed change rate exceeds the threshold.

The schedule control function 40*d* is also a function to determine for each stand whether or not the rolling reduction rate is within the permissible range. The schedule control function 40*d* is also a function to changing the rolling reduction rate of the stand to an upper limit value or a lower limit value when it is determined in the same stand that the rolling reduction rate is outside the permissible range.

The schedule control function 40*d* is also a function to reset the plate thickness schedule, change the plate thickness changing time and execute again the determination relating the speed change rate and the rolling reduction rate when it is determined that the plate thickness of the strip in the delivery side of the final stand cannot achieve the target value as a result of the adjustment of the change amount of the plate thickness of the rolling material in each stand and the adjustment of the rolling reduction rate in each stand.

<Feature of Temperature Control in Second Embodiment>

Figure 17:
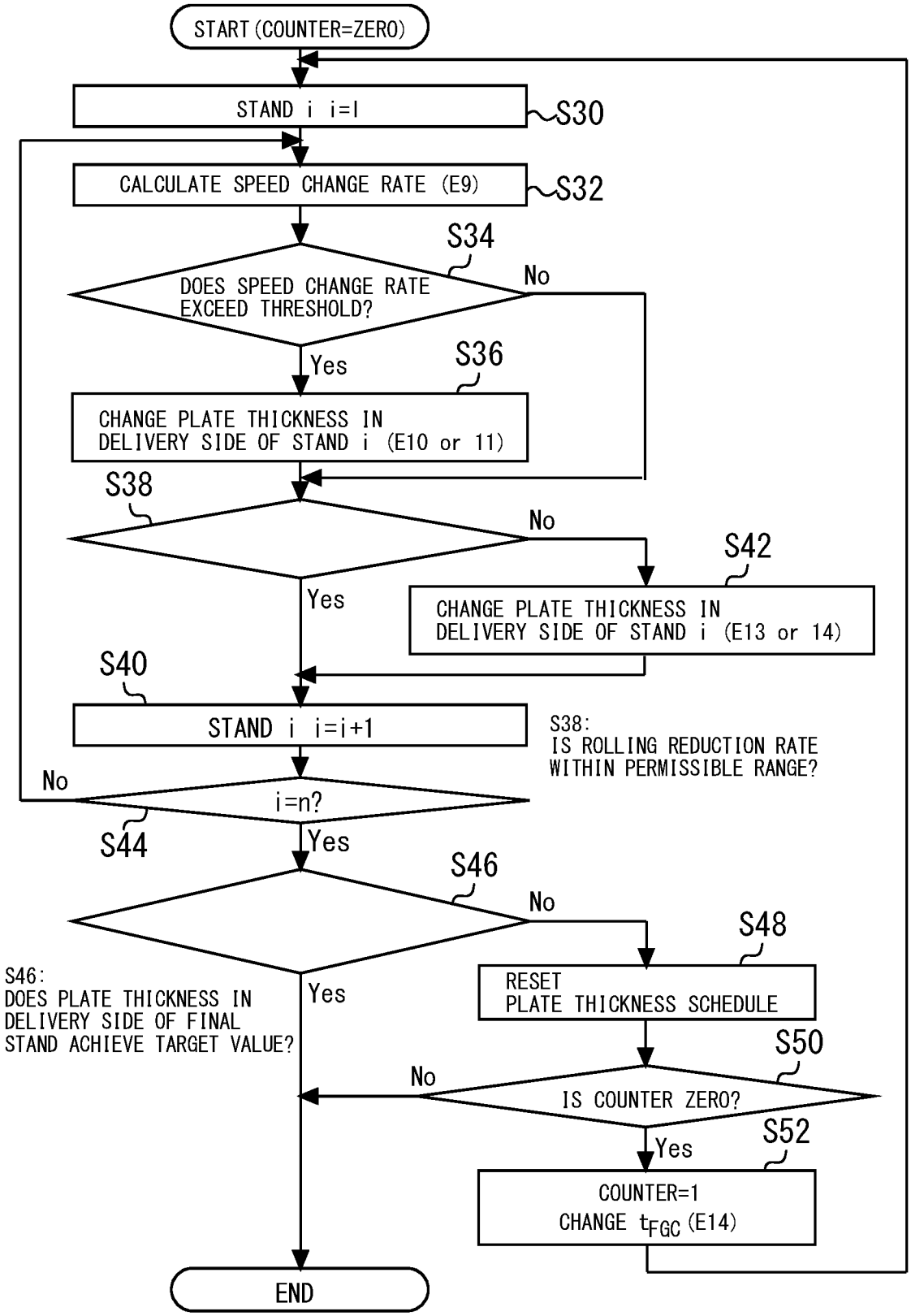
FIG. 17 is a flow chart for explaining exemplary processing when the temperature control device according to the second embodiment of the present invention executes the operation related to scheduling.

FIG. 17 is a flow chart for explaining exemplary processing when the temperature control device according to the second embodiment of the present invention executes the operation related to scheduling. In the routines shown in FIG. 17, a default value of a counter is set to zero.

In the routine shown in FIG. 17, the temperature control device first inputs an initial value i=1 of the stand i (step S30), and calculates the speed change rate $\Delta\alpha(i)$ of the rolling material in the stand i ($1 \le i \le n$) (step S32). The speed change rate $\Delta\alpha(i)$ is expressed by the following equation (9) using an equation obtained by replacing the variable of the equation (8) with i from k and the plate thickness changing time $t_{FGC}$.

$$\Delta\alpha(i)=\Delta v(i)/t_{FGC} \tag{9}$$

$$\Delta v(i)=v(i)^{A(j)}-v(i)^{A(j-1)}$$

$v(i)^{A(j)}$: the speed of the rolling material in the delivery side of the stand i at the timing when the plate thickness changing point is between the stand j ($i \le j \le n$) and the stand j+1 [m/s]

$v(i)^{A(j-1)}$: the speed of the rolling material in the delivery side of the stand k at the timing when the plate thickness changing point is between the stand j−1 and the stand j [m/s]

Subsequent to the step S32, the temperature control device determines whether or not an absolute value abs($\Delta\alpha$(i)) of the speed change rate of the rolling material (i.e., acceleration rate or deceleration rate of the rolling material) $\Delta\alpha(i)$ exceeds a threshold value $\Delta\alpha^{thre}$ (step S34).

If it is determined in the step S34 that $abs(\Delta\alpha(i))>\Delta\alpha^{thre}$ is satisfied, the temperature control device corrects the target value $h(i)^B$ of the plate thickness in the delivery side of the stand i using the equation (10) or the equation (11) according to the value of $\Delta\alpha(i)$ (step S36). The temperature control device calculates the optimal $t_{FGC}^{opt}$ of the plate thickness changing time $t_{FGC}$ using the following equation (12).

$$h(i)^B=h(i)^A/\{(h(i-1)^A h(i-1)^B)+(t_{FGC}*\Delta\alpha^{thre}v(n)^{A(j)})\} \quad (\text{if } \Delta\alpha(i)>0) \tag{10}$$

$$h(i)^B=h(i)^A/\{(h(i-1)^A h(i-1)^B)-(t_{FGC}*\Delta\alpha^{thre}v(n)^{A(j)})\} \quad (\text{if } \Delta\alpha(i)<0) \tag{11}$$

$$t_{FGC}^{opt}(i)=\Delta v(i)/\Delta\alpha^{thr} \tag{12}$$

Subsequent to the step S36, the temperature control device determines whether or not the rolling reduction rate $\gamma(i)$ of the stand i is within the permissible range (step S38). In the step S38, the rolling reduction rate $\gamma(i)$ is calculated as follows:

$$\gamma(i)=(h(i-1)^B-h(i)^B)/h(i-1)^B \tag{13}$$

The permissible range is defined by an upper limit $\gamma(i)^{high}$ and a lower limit $\gamma(i)^{low}$ of the rolling reduction rate of the predetermined stand i. When it is determined that the rolling reduction rate $\gamma(i)$ calculated by using the equation (13) is within the permissible range, the temperature control device proceeds to the processing of step S40.

On the other hand, if it is determined in the step S38 that the rolling reduction rate $\gamma(i)$ calculated by using the equation (13) is outside the permissible range, the temperature control device corrects the target value $h(i)^B$ of the plate thickness in the delivery side of the stand i using the following equation (14) or equation (15) (step S42).

$$h(i)^B=h(i)^B*(1-\gamma(i)^{high}) \quad (\text{if } \gamma(i)>\gamma(i)^{high}) \tag{14}$$

$$h(i)^B=h(i)^B*(1-\gamma(i)^{low}) \quad (\text{if } \gamma(i)<\gamma(i)^{low}) \tag{15}$$

In the step S40, the temperature control device updates the valued of the stand i to i+1. Subsequently, the temperature control device determines whether or not i=n is satisfied for the present value of the stand i (step S44). When it is determined that i=n is not satisfied, the temperature control device returns to the processing of the step S32.

If it is determined in the step S44 that i=n is established, the temperature control device determines whether or not the plate thickness $h(n)^B$ of the strip in the delivery side of the final stand n achieves the target value (step S46). The temperature control device determines whether or not a difference between the plate thickness $h(n)^B$ and the target value is less than the threshold value, and determines whether or not the target value is achieved. If it is determined that the difference is equal to or greater than the threshold value, the temperature control device resets the plate thickness schedule once in operation S48. If it is determined that the difference is less than the threshold, the temperature control device exits the routine.

Subsequent to the step S48, the temperature control device determines whether or not the value of the counter is zero (step S50). If it is determined that the value of the counter is zero, the temperature control device changes the value of the counter from zero to one, and changes the plate thickness changing time $t_{FGC}$ using the following equation (16) (step S52).

$$t_{FGC}=\max(t_{FGC}^{opt}(1),t_{FGC}^{opt}(2), \ldots ,t_{FGC}^{opt}(n),t_{FGC}^{maxlmt}) \tag{16}$$

After the change of the plate thickness changing time $t_{FGC}$, the temperature control device returns to the processing of the step S30. On the other hand, if it is determined in the step S50 that the value of the counter is not zero, the temperature control device exits the routine.

As described above, according to the routines shown in FIG. 17, the change amount of the plate thickness of the rolling material in the stand i can be adjusted based on the comparison between the speed change rate $\Delta\alpha(i)$ of the stand i and the threshold value. The rolling reduction rate $\gamma(i)$ can also be adjusted based on the comparison of the rolling reduction rate $\gamma(i)$ of the stand i with the permissible value. Furthermore, it is also possible to make the determination again on the speed change rate $\Delta\alpha(i)$ and the rolling reduction rate $\gamma(i)$ based on the comparison of the plate thickness $h(n)^B$ of the strip in the delivery side of the final stand n with the thresholds. Therefore, it is possible to suppress in each stand a sharp change in the speed of the rolling material due to the flying thickness change by keeping the speed change rate and the rolling reduction rate within appropriate ranges. Therefore, it is possible to further improve the accuracy of the temperature control by the temperature control device.

REFERENCE SIGNS LIST

10 Continuous caster
14 Roughing mill
16 Finishing mill
20 Coiler
22 Roughing mill delivery-side thermometer
24 Finishing mill entry-side thermometer
26 Finishing mill delivery-side temperature meter
28 Coiler entry-side thermometer
30 Heat exchanger
32, 34 Cooler
40 Setting calculation function
40*a* Flying thickness change amount determination function
40*b* Speed change amount calculation function
40*c* Speed pattern create function
40*d* Schedule control function
42 Temperature control function
42*a* Initial output determination function
42*b* Feedforward control function
42*c* Feedback control function
44 Gap change function
46 Speed control function
48 Tracking function
50 Operation instruction
52 Measured temperature value
54 Plate thickness changing point
60 Preceding material
60*a*, 62*a* Head end portion
62 Succeeding material
64 Site

The invention claimed is:

1. A temperature control device for endless rolling line which is configured to control temperature of a material to be rolled to in an endless rolling line in which a continuous caster is directly connected with a hot rolling line, wherein the endless rolling line comprising:

a heating furnace which is configured to heat the material to be rolled extracted from the continuous caster;

a mill which is configured to roll the material to be rolled extracted from the heating furnace with a plurality of stands;

a heat exchanger which is disposed downstream of the mill and/or between the stands of the mill, and is configured to exchange heat with at least one of the material to be rolled after rolling by the mill and the material to be rolled during rolling by the mill;

a delivery-side thermometer which is disposed downstream of the heat exchanger; and an entry-side thermometer which is disposed upstream of the heat exchanger, wherein the material to be rolled includes a preceding material and a succeeding material that are produced from the material to be rolled, wherein the temperature control device is further configured to:

calculate, with respect to each of the preceding and succeeding materials, a plate thickness schedule which defines stand delivery-side target plate thicknesses which are target values of the material to be rolled in each delivery side of the stands based on an operation instruction including a target plate length which is a target value of plate length of the material to be rolled, a mill delivery-side target plate thickness which is the target value of plate thickness of the material to be rolled in the delivery side of the mill, and a target temperature which is a target value of temperature of the material to be rolled when it passes through a position where the delivery-side thermometer is disposed;

execute predictive calculation of speed change amount of the material to be rolled in each delivery side of the stands that changes when the mill delivery-side target plate thickness is changed between the preceding and succeeding materials based on the plate thickness schedule and the speed of material to be rolled in each delivery side of the stands;

create, with respect to each of the preceding and succeeding materials, a speed pattern on the material to be rolled based on the speed change amount;

execute feedforward control of heat exchanging amount based on the latest speed pattern of the material to be rolled and a measured temperature value from the entry-side thermometer; and execute feedback control of the heat exchanging amount based on an error between the measured temperature value from the delivery-side thermometer and the target temperature, wherein the temperature control device is further configured to:

create the speed pattern of a preceding material at which a head end portion of the preceding material is extracted from the heating furnace;

execute first update of the speed pattern of the preceding material at which the head end portion of the preceding material reaches the mill;

execute second update of the speed pattern of the preceding material and create the speed pattern of the succeeding material at which the head end portion of the succeeding material is extracted from the heating furnace; and execute third update of the speed pattern of the preceding material and update of the speed pattern of the succeeding material at which the head end portion of the succeeding material reaches the mill.

2. The temperature control device for endless rolling line according to claim 1, wherein the temperature control device is further configured to:

calculate, based on the operation instruction, a plate thickness changing time as time required to change the plate thickness of the material to be rolled in the delivery side of the mill when the mill delivery-side target plate thickness is changed between the preceding and succeeding materials;

calculate speed change rate of the material to be rolled in each delivery side of the stands in case of changing the mill delivery-side target plate thickness between the preceding and succeeding materials by dividing the speed change amount by the plate thickness changing time; and if the speed change rate of the stand is outside a permissible range, change the stand delivery-side target plate thickness of the same stand.

3. The temperature control device for endless rolling line according to claim 1, wherein the temperature control device is further configured to:

calculate rolling reduction rate of each stand in case of changing the mill delivery-side target plate thickness between the preceding and succeeding materials; and if the rolling reduction rate of the stand is outside a permissible range, change the stand delivery-side target plate thickness of the same stand.

4. The temperature control device for endless rolling line according to claim 2, wherein the temperature control device is further configured to:

calculate rolling reduction rate of each stand in case of changing the mill delivery-side target plate thickness between the preceding and succeeding materials; and if the rolling reduction rate of the stand is outside the permissible range, change the stand delivery-side target plate thickness of the same stand.

* * * * *